US008075378B2

(12) United States Patent
Okada

(10) Patent No.: US 8,075,378 B2
(45) Date of Patent: Dec. 13, 2011

(54) HORSE RACE GAMING MACHINE

(75) Inventor: Kazuo Okada, Tokyo (JP)

(73) Assignee: Aruze Gaming America, Inc., Las Vegas, NV (US)

( * ) Notice: Subject to any disclaimer, the term of this patent is extended or adjusted under 35 U.S.C. 154(b) by 528 days.

(21) Appl. No.: 12/345,253

(22) Filed: Dec. 29, 2008

(65) Prior Publication Data

US 2009/0233669 A1 Sep. 17, 2009

Related U.S. Application Data

(60) Provisional application No. 61/036,199, filed on Mar. 13, 2008.

(51) Int. Cl.
*A63F 9/24* (2006.01)

(52) U.S. Cl. ..... 463/6; 463/25; 463/26; 463/28; 463/42

(58) Field of Classification Search ..... 463/6, 25–26, 463/28, 42
See application file for complete search history.

(56) References Cited

U.S. PATENT DOCUMENTS

| | | | | |
|---|---|---|---|---|
| 4,199,147 | A | 4/1980 | Stansberry | |
| 4,874,177 | A | 10/1989 | Giardin | |
| 6,676,514 | B1 * | 1/2004 | Kusuda et al. | 463/24 |
| 6,692,360 | B2 * | 2/2004 | Kusuda et al. | 463/42 |
| 6,805,629 | B1 * | 10/2004 | Weiss | 463/16 |
| 7,607,975 | B2 * | 10/2009 | Sato et al. | 463/6 |
| 2001/0011034 | A1 * | 8/2001 | Sogabe | 463/1 |
| 2003/0054870 | A1 * | 3/2003 | Sato et al. | 463/6 |
| 2003/0119570 | A1 * | 6/2003 | Maroun | 463/6 |
| 2003/0139209 | A1 * | 7/2003 | Nakayama | 463/6 |
| 2004/0235542 | A1 * | 11/2004 | Stronach et al. | 463/6 |
| 2005/0044575 | A1 * | 2/2005 | Der Kuyl | 725/100 |
| 2007/0265069 | A1 * | 11/2007 | Okada | 463/31 |
| 2008/0125203 | A1 * | 5/2008 | Sato et al. | 463/6 |
| 2008/0132314 | A1 * | 6/2008 | Robb et al. | 463/17 |
| 2008/0176657 | A1 * | 7/2008 | Okada | 463/42 |

FOREIGN PATENT DOCUMENTS

JP 2006231073 A * 9/2006

* cited by examiner

*Primary Examiner* — N Drew Richards
*Assistant Examiner* — Ankush Singal
(74) *Attorney, Agent, or Firm* — NDQ&M Watchstone LLP

(57) ABSTRACT

In a horse race gaming machine 1, a performance point is calculated on each of the player's racehorses, based on the results of respective racing games (S501). The number of wins, the number of races, a winning percentage, best time, etc. by the racehorses are taken into consideration when calculating the performance point. If the performance point satisfies a predetermined condition (S502: YES), an expense that was paid about that the player is an owner of a racehorse is refunded to the player (S503). The expense includes, for example, a credit amount which is required of the player to purchase a racehorse, or includes a credit amount or the points which is required of the player to make a race entry in a racing game for the player's racehorse.

5 Claims, 21 Drawing Sheets

| RACEHORSE | CHARACTER ID |
| --- | --- |
|  | RACEHORSE 001 |
|  | RACEHORSE 002 |
|  | RACEHORSE 003 |
| ⋮ | ⋮ |

| CHARACTER ID | PLAYER ID |
| --- | --- |
| RACEHORSE 001 | PLAYER 05102 |
| RACEHORSE 002 | — |
| RACEHORSE 003 | PLAYER 0031 |
| ⋮ | ⋮ |

FIG. 16

| △△○ RACE | |
|---|---|
| 1 | RACEHORSE 325 |
| 2 | |
| 3 | |
| 4 | |
| 5 | |
| 6 | |
| 7 | |
| 8 | |

FIG. 21

| PLAYER ID | PLAYER 05671 | | | | |
|---|---|---|---|---|---|
| RACEHORSE ID | NUMBER OF WINS | NUMBER OF RACES | WINNING PERCENTAGE | BEST TIME | PERFORMANCE POINT |
| RACEHORSE 313 | 10 | 52 | 0.19 | 56.8 | 15 |
| RACEHORSE 671 | 3 | 61 | 0.05 | 59.3 | 3 |
| ⋮ | ⋮ | ⋮ | ⋮ | ⋮ | ⋮ |

FIG. 22

| PERFORMANCE POINT | JACKPOT PRIZE |
|---|---|
| 1000 | 100% |
| 900 | 5% |
| 700 | 3% |
| 500 | 1% |
| 300 | 0.3% |
| 100 | 0.2% |
| 10 | 0.1% |

HORSE RACE GAMING MACHINE

CROSS-REFERENCE TO RELATED APPLICATIONS

This application is based upon and claims a priority from the U.S. Provisional Patent Application No. 61/036,199 filed on Mar. 13, 2008, the entire contents of which are incorporated herein by reference.

BACKGROUND

1. Field of the Invention

The present invention relates to a horse race gaming machine for executing racing games.

2. Description of Related Art

Conventionally, as one of gaming machines, there has been a horse race gaming machine for executing racing games, as described in U.S. Pat. Nos 4,874,177 or 4,199,147, etc.

In this respect, in the gaming machines, there are a number of models that award a player with a different prize (e.g., jackpot) from that to be awarded to him/her in a main game. Therefore, also in a horse race gaming machine, if a different prize from that awarded to players in a racing game could be awarded to the players, it would be possible to excite them.

Needless to say, racing games to be played on a horse race gaming machine are created based on horse racing. Thus, racing games include such different components as not only a winning horse, order of arrival, but also past performance of racehorses, earnings of racehorse owners, etc.

In other words, even in addition to an original racing game in which a prize is awarded to players who guessed right a winning horse or order of arrival, if a horse race gaming machine was configured to award players a prize related to that racing game, it could also excite the players.

SUMMARY

The present invention is made in light of the above, and it is an object of the present invention to provide a novel, unprecedented horse race gaming machine by configuring it so that players can be awarded a prize related to a result of a racing game, in addition to a prize to be awarded to players who guessed right a result of a racing game.

To achieve the object of the present invention, there is provided a horse race gaming machine comprising: a plurality of racing games constituting a horse racing game; a plurality of stations each provided with an input device with which a player inputs information used for progressing the horse racing game; a performance point which is given to racehorses individually based on a racing game result of the racing game each time the racing game ends; a horse owning expense, in which a credit amount being collected as the horse-owning-expense from a player who owns any of the racehorses is accumulated; and a processor which is programmed, for progressing the horse racing game by controlling the plurality of stations, to execute processes of: (1) determining whether or not a player has become an owner of any one of the racehorses based on an input made by the player using the input device; and (2) in the station at which the player who is determined to have become an owner of any one of the racehorses is playing: (2-1) collecting a predetermined credit amount from all of credit amount which the player has at each predetermined timing; (2-2) accumulating the credit amount collected in the horse owning expense; (2-3) determining whether or not a performance point of the racehorse whose owner is the player satisfies a predetermined condition after every ending of the racing game; and (2-4) refunding a credit amount corresponding to a content of the performance point to the player at each time it is determined that the performance point of the racehorse whose owner is the player satisfies the predetermined condition.

BRIEF DESCRIPTION OF THE DRAWINGS

FIG. 16 is a view showing one example of a data table;

FIG. 21 is a view showing one example of a data table; and

FIG. 22 is a view showing one example of a data table.

DETAILED DESCRIPTION

[1. Characteristics of a Horse Race Gaming Machine]

In the following, a description is made on embodiments of the present invention with reference to drawings.

Figure 2:
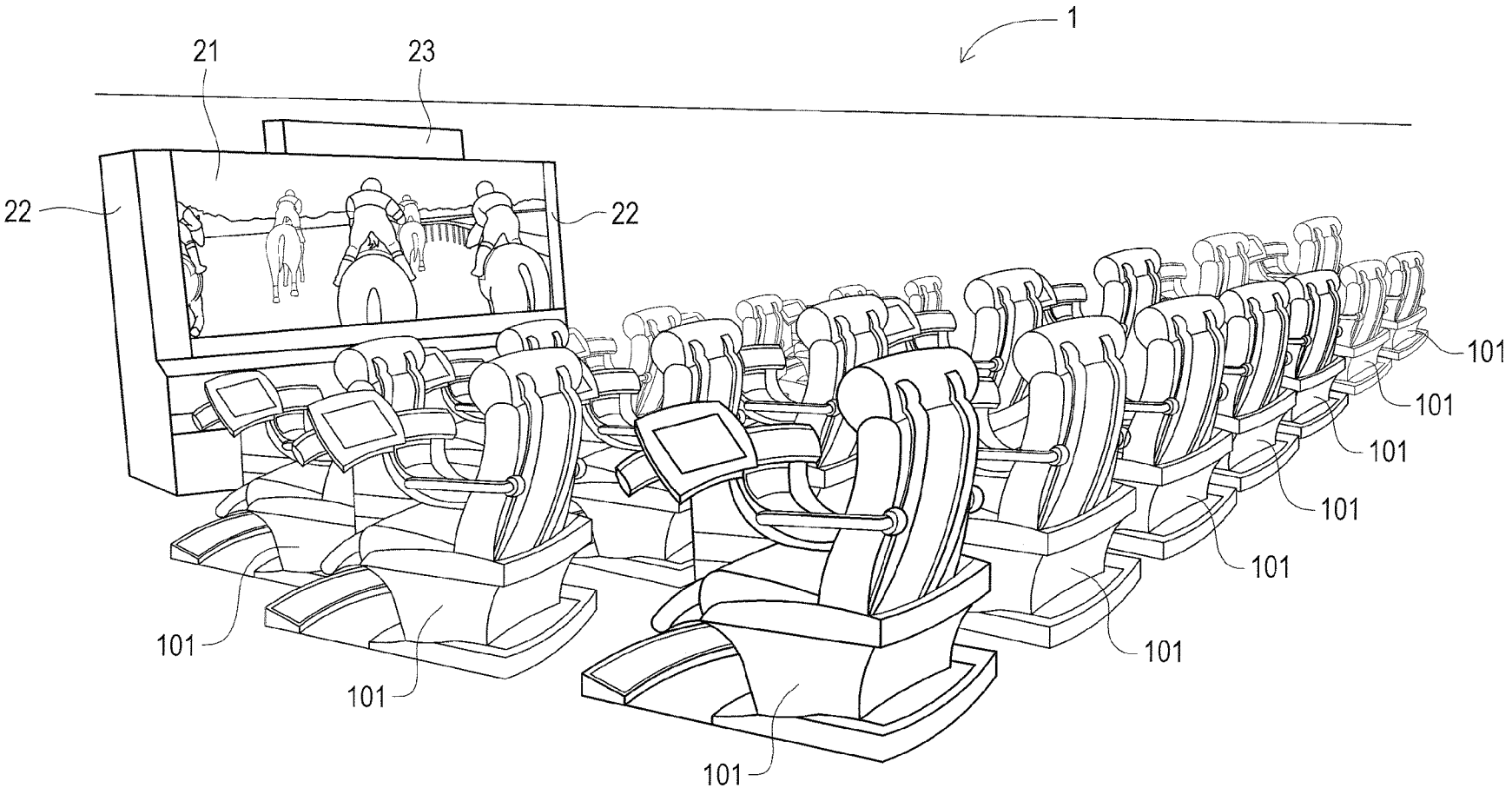
FIG. 2 is a perspective view of the horse race gaming machine.
Figure 3:
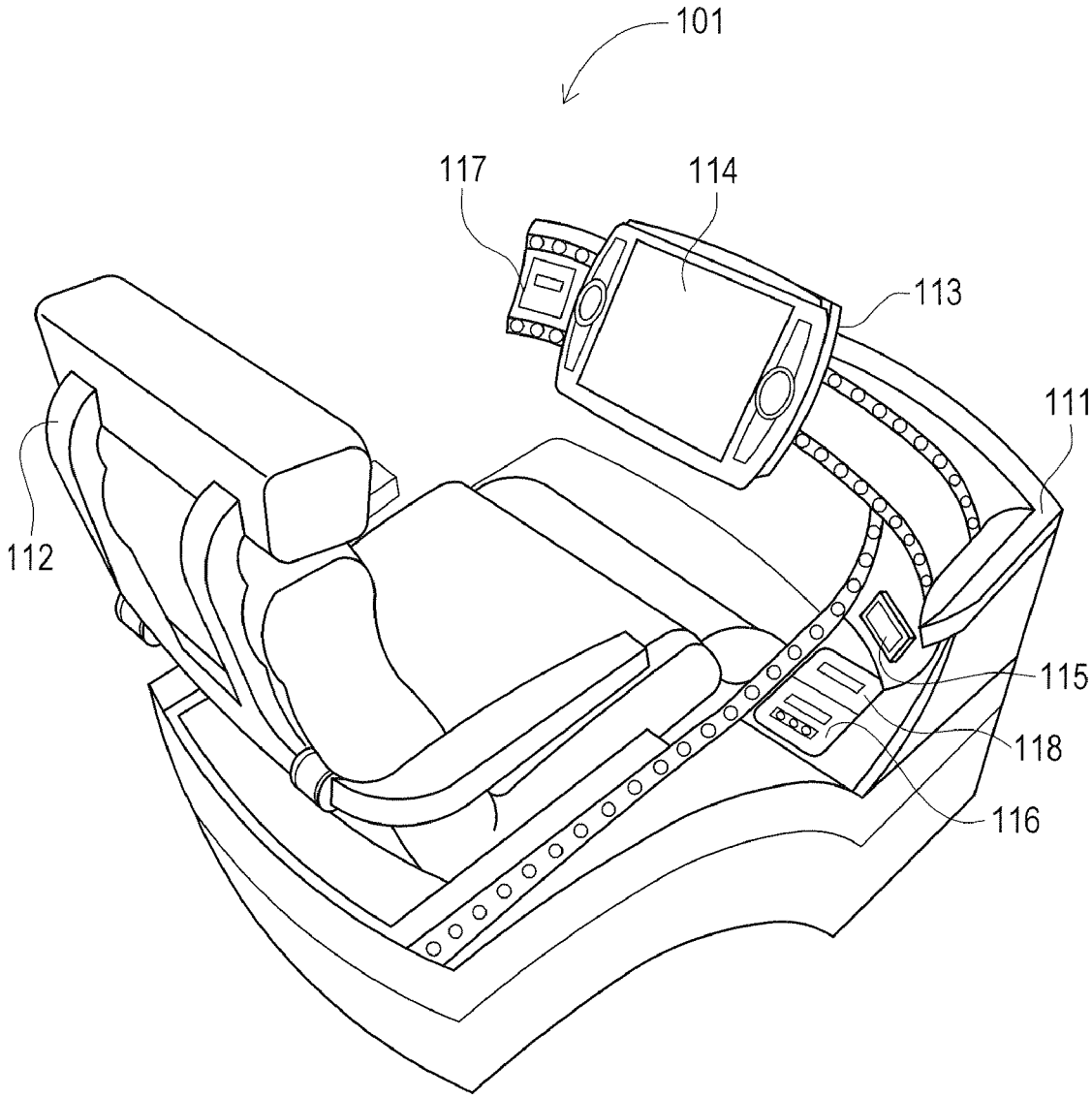
FIG. 3 is a perspective view of a station.

FIG. 2 is a perspective view of a horse race gaming machine 1 that is one embodiment of the present invention. As shown in FIG. 2, the horse race gaming machine 1 of this embodiment has a main monitor 21 and a plurality of stations 101. The main monitor 21 displays images of a horse racing game. Players being seated at the respective stations 101 can respectively participate in this horse racing game. The players being seated at the respective stations 101 participate in this horse racing game by forecasting a result of each racing game of the horse racing game and performing BET operations. Namely, a horse racing game is constituted of a number of racing games that are intermittently executed in a sequential manner. FIG. 3 is a perspective view of the station 101. A sub monitor 113 or a touch panel 114 that each station 101 is provided with is used to perform BET operations.

In this respect, in the horse race gaming machine 1 of this embodiment, betting on racing game result can be performed before or during the racing game.

Figure 1:
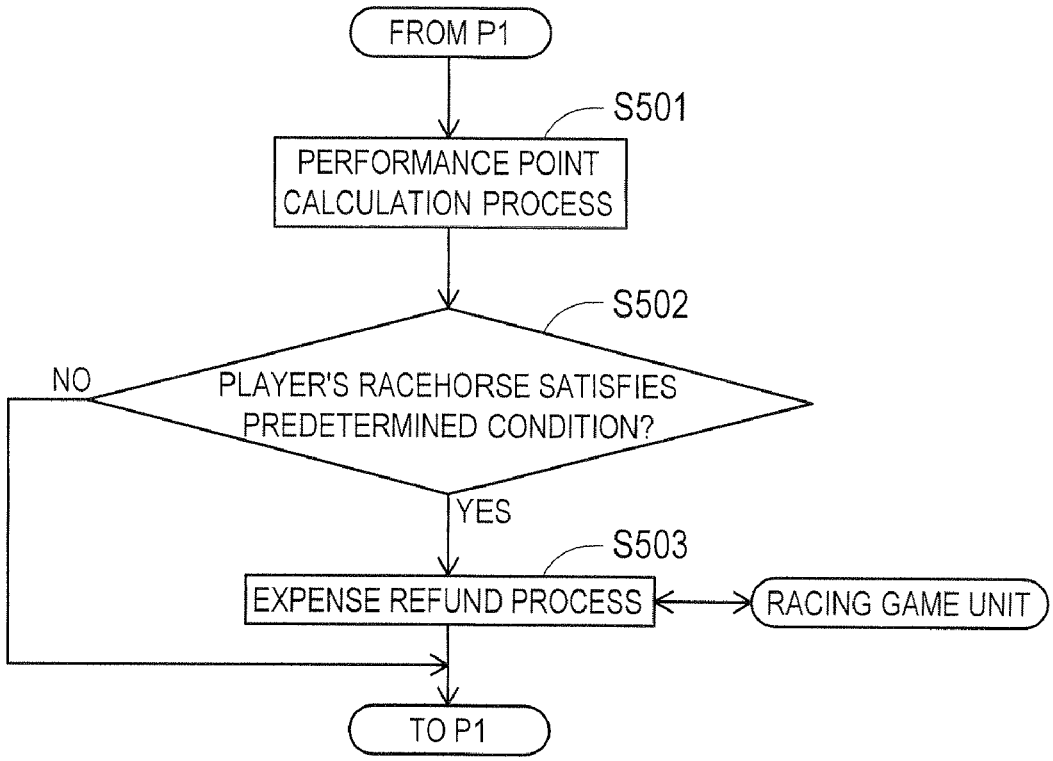
FIG. 1 is a view showing characteristics of a horse race gaming machine of one embodiment of the present invention and a flow chart diagram showing one example of game operations in the horse race gaming machine.

FIG. 1 is a view showing characteristics of the horse race gaming machine 1 of this embodiment and a flow chart diagram showing one example of game operations in the horse race gaming machine 1. In the horse race gaming machine 1 of this embodiment, a performance point is calculated on each of the player's racehorses, based on the results of respective racing games (S501). The number of wins, the number of races, a winning percentage, best time, etc. by the racehorses are taken into consideration when calculating the performance point (refer to FIG. 21 below). If the performance point satisfies a predetermined condition (S502: YES), an expense that was paid about that the player is an owner of a racehorse is refunded to the player (S503).

For example, the expense includes the following:

(1) A credit amount which is required of a player to purchase a racehorse (S309, S312 in FIG. 18 below);

(2) A credit amount which is required of a player to make a race entry in a racing game for the player's racehorse (S413, S414 in FIG. 19 below); and (3) The points which is required of a player to make a race entry in a racing game for the player's racehorse (S412, S414 in FIG. 19 below). It is to be noted that the points are paid from an entry point given to the player in accordance with a BET amount specified by the player.

[2. Appearance of a Horse Race Gaming Machine]

As shown in FIG. 2, the horse race gaming machine 1 of this embodiment has the main monitor 21, speakers 22, a display device 23, the plurality of stations 101, etc. The main monitor 21 displays images of a horse racing game, etc. The speakers 22 output sound of a horse racing game, etc. The display device 23 displays information about games in general.

As shown in FIG. 3, in each station 101, a cabinet 111 is provided with a chair 112, the sub monitor 113, the touch panel 114, a bill identifying device 115, a ticket printer 116, an IC card issuing device 117, a reader/writer 118, etc. A player sits on the chair 112. The sub monitor 113 displays BET images described later, etc. The touch panel 114 is provided on the screen of the sub monitor 113. When the player performs the BET operations utilizing the regular BET image described later or the high BET image described later or the player performs specific operations utilizing an owner image described later or an entry-possible race image described later, the touch panel 114 is used.

The bill identifying device 115 not only identifies whether or not a bill is appropriate but also receives legitimate bills into the cabinet 111. Then, bills inserted into the cabinet 111 are converted into the number of coins, and the credit amount that corresponds to the converted number of coins is added as the player's own credit amount. The bill identifying device 115 is also configured to be capable of reading bar coded tickets described later.

The ticket printer 116 is a printer that prints on a ticket a bar code representative of coded data such as a player's own credit amount, date, identification number of the station 101, etc. and outputs it as a bar coded ticket. A player can have the outputted bar coded ticket read by other station 101 and play at this other station 101, or use it for any procedure in predetermined places in a game arcade.

The IC card issuing device 117 is a device that issues an IC card 119 (refer to FIG. 5 below) on which horse owner information 501 (refer to FIG. 15 below) is stored. The IC card 119 (refer to FIG. 5 below) is inserted into the reader/writer 118.

[3. Example of Configuration of a Racing Game Unit]

Figure 4:
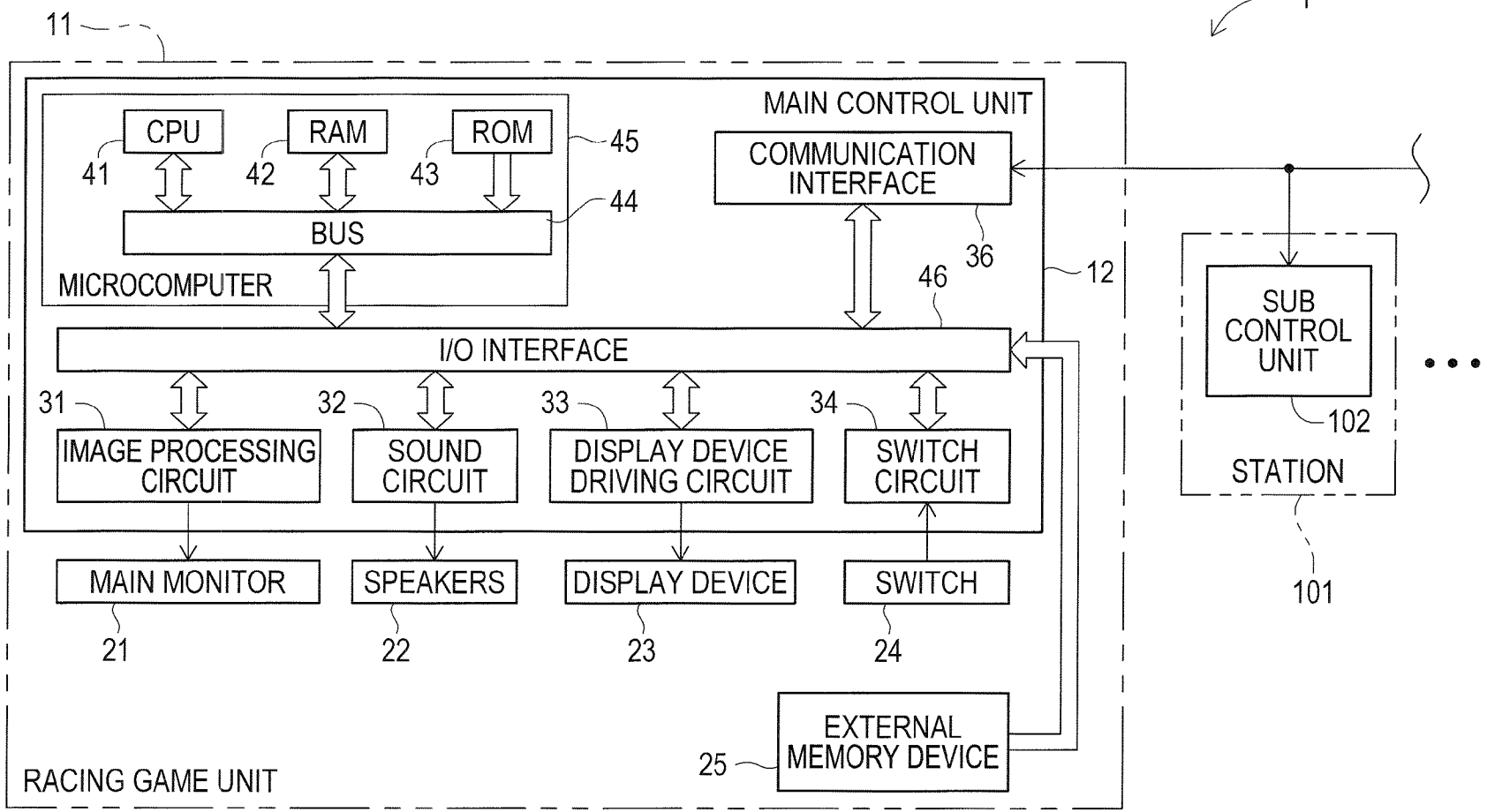
FIG. 4 is a block diagram of a racing game unit.

A racing game unit is an opposite concept of each station 101 and constitutes a core of the horse race gaming machine 1 of this embodiment. FIG. 4 is a block diagram of a racing game unit 11. As shown in FIG. 4, the racing game unit 11 is composed of a main control unit 12, the main monitor 21, the speakers 22, the display device 23, a switch 24, an external memory device 25, etc. The main control unit 12 and external memory device 25 are provided separately from the main monitor 21, the speakers 22, or the display device 23. Although the switch 24 is annexed to the main control unit 21, it may be provided individually.

The main control unit 12 is generally composed of a microcomputer 45 as the kernel comprising a CPU 41, a RAM 42, a ROM 43 and a bus 44 for transferring data mutually between these elements. The RAM 42 and the ROM 43 are connected to the CPU 41 via the bus 44. The RAM 42 is a memory for temporarily storing a variety of data which have been operated in the CPU 41. The ROM 43 stores various types of programs, data tables or the like for executing necessary processes to control the horse race gaming machine 1.

An image processing circuit 31 is connected to the microcomputer 45 via an I/O interface 46. The image processing circuit 31 is connected to the main monitor 21 and controls driving of the main monitor 21.

The image processing circuit 31 is composed of a program ROM, an image ROM, an image control CPU, a work RAM, a VDP (video display processor), and a video RAM, etc. And in the program ROM, an image control program related to display on the main monitor 21, and various selection tables are stored. And, in the image ROM, dot data to form images and the like, for example dot data to form images displayed on the main monitor 21, are stored. And, based on parameters set by the microcomputer 45, the image control CPU determines the images displayed on the main monitor 21 among the dot data stored beforehand in the image ROM, according to the image control program stored beforehand in the program ROM. And, the work RAM works as a temporary memory when the image control program is executed in the image control CPU. And the VDP forms image data corresponding to display contents determined by the image control CPU. And the VDP outputs the image data formed thereby to the main monitor 21. And the video RAM works as a temporary memory when the images are formed by the VDP.

A sound circuit 32 is connected to the microcomputer 45 via the I/O interface 46. The speakers 22 are connected to the sound circuit 32 and are arranged on both lateral sides of the main monitor 21. The speakers 22 output various types of effect sound, BGM, etc. when various types of effect are performed, by being subjected to output control by the sound circuit 32 based on a drive signal from the CPU 41.

A display device driving circuit 33 is connected to the microcomputer 45 via the I/O interface 46. The display device 23 is connected to the display device driving circuit 33. The display device 23 is disposed on the upper side of the main monitor 21 and displays information about games in general, by being subjected to display control by the display device driving circuit 33 based on a drive signal from the CPU 41.

A switch circuit 34 is connected to the microcomputer 45 via the I/O interface 46. The switch 24 is connected to the switch circuit 34 and is arranged in the lower part of the main monitor 21. The switch 24 inputs an instruction by an operator's setting operation into the CPU 41 based on a switch signal from the switch circuit 34.

The external memory device 25 is connected to the microcomputer 45 via the I/O interface 46. The external memory device 25 is arranged in the periphery of the main monitor 21 and has capability similar to the image ROM in the image processing circuit 31, by storing dot data for forming images, such as dot data for forming images on the main monitor 21. Thus, when determining any image to be displayed on the main monitor 21, the image control CPU in the image processing circuit 31 adds the dot data stored in advance in the external memory device 25 to a target of the determination.

A communication interface 36 is connected to the microcomputer 45 via the I/O interface 46. A sub control unit 102 of each station 101 is connected to the communication interface 36. This enables bidirectional communication between the CPU 41 and each station 101. The CPU 41 can receive and transmit a command, request and data from/to each station 101 via the communication interface 36. Therefore, in the horse race gaming machine 1, the main control unit 12 controls progress of the horse racing game in cooperation with each station 101.

[4. Example of Configuration of a Station]

Figure 5:
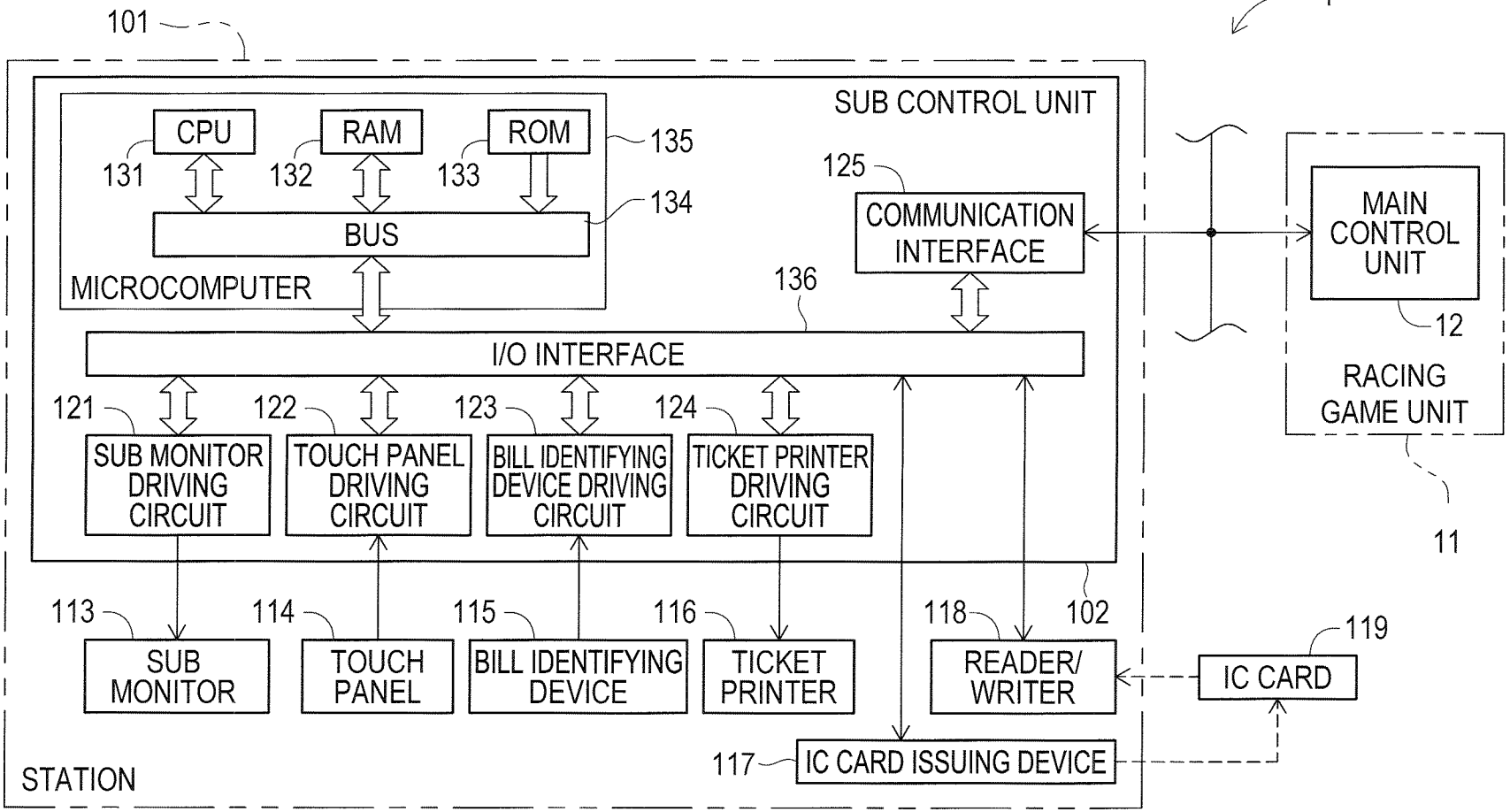
FIG. 5 is a block diagram of the station.

FIG. 5 is a block diagram of a station 101. As shown in FIG. 5, the station 101 is composed of the sub control unit 102, the sub monitor 113, the touch panel 114, the bill identifying device 115, the ticket printer 116, the IC card issuing device 117, the reader/writer 118, etc.

The sub control unit 102 is generally composed of a microcomputer 135 as the kernel comprising a CPU 131, a RAM 132, a ROM 133 and a bus 134 for transferring data mutually between these elements. The RAM 132 and the ROM 133 are connected to the CPU 131 via the bus 134. The RAM 132 is a memory for temporarily storing a variety of data which have been operated in the CPU 131. The ROM 133 stores various types of programs, data tables or the like for executing necessary processes to control the horse race gaming machine 1.

A sub monitor driving circuit 121 is connected to the microcomputer 135 via an I/O interface 136. The sub monitor 113 is connected to the sub monitor driving circuit 121. The sub monitor driving circuit 121 controls driving of the sub monitor 113 based on a drive signal from the aforementioned racing game unit 11. The sub monitor driving circuit 121 has also similar configuration and capabilities to the image processing circuit 31 as shown in FIG. 4 above, and controls driving of the sub monitor 113 so that the regular BET image, the high BET image, the owner image or the entry-possible race image described later are displayed.

A touch panel driving circuit 122 is connected to the microcomputer 135 via the I/O interface 136. The touch panel 114 is connected to the touch panel driving circuit 122 and is arranged on the screen of the sub monitor 113. The touch panel 114 inputs an instruction into the CPU 131 through touch operation of a player (touch position), based on a coordinate signal from the touch panel driving circuit 122.

A bill identifying driving circuit 123 is connected to the microcomputer 135 via the I/O interface 136. The bill identifying device 115 is connected to the bill identifying driving circuit 123. The bill identifying device 115 identifies whether or not a bill or a bar coded ticket is appropriate. When receiving a legitimate bill, the bill identifying device 115 inputs a value of the bill into the CPU 131 based on an identification signal from the bill identifying driving circuit 123. In addition, when receiving a legitimate bar coded ticket, the bill identifying device 115 inputs a credit amount, etc. recorded on the bar coded ticket into the CPU 131 based on an identification signal from the bill identifying driving circuit 123.

A ticket printer driving circuit 124 is connected to the microcomputer 135 via the I/O interface 136. The ticket printer 116 is connected to the ticket printer driving circuit 124. The ticket printer 116 prints on a ticket a bar code representative of coded data such as owned credit amount, etc., stored in the RAM 132, and outputs it as a bar coded ticket, by being subjected to output control by the ticket printer driving circuit 124 based on a drive signal to be outputted from the CPU 131.

The IC card issuing device 117 is connected to the microcomputer 135 via the I/O interface 136. With an output controlled based on a drive signal to be outputted from a CPU 131, the IC card issuing device 117 issues an IC card 119 that stores data such as horse owner information 501 (refer to FIG. 15 below), etc.

The reader/writer 118 is connected to the microcomputer 135 via the I/O interface 136. With a drive controlled based on a drive signal to be outputted from the CPU 131, the reader/writer 118 inputs information read from an IC card 119 into CPU 131 or stores various types of information such as horse owner information 501 (refer to FIG. 15 below) into an IC card 119.

A communication interface 125 is connected to the microcomputer 135 via the I/O interface 136. The main control unit 12 of the racing game unit 11 is connected to the communication interface 125. This enables bidirectional communication between the CPU 131 and the racing game unit 11. The CPU 131 can receive and transmit a command, request and data from/to the racing game unit 11 via the communication interface 125. Therefore, in the horse race gaming machine 1, the sub control unit 102 controls progress of the horse racing game in cooperation with the racing game unit 11.

[5. Example of Game Operations of a Horse Race Gaming Machine]

Figure 17:
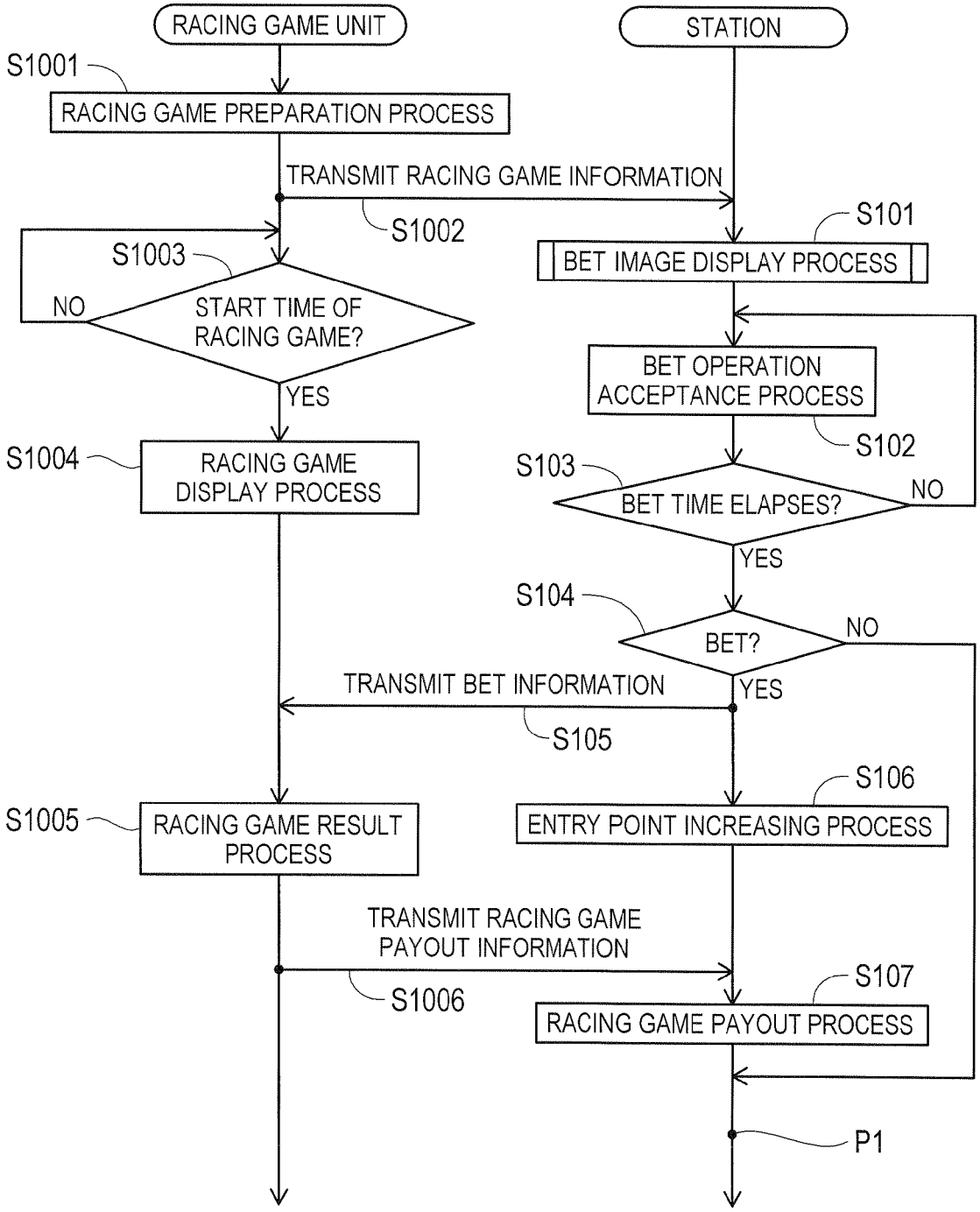
FIG. 17 is a flow chart diagram showing one example of game operations in the horse race gaming machine.

In the following, a description is made on an example of game operations of the horse race gaming machine 1 of this embodiment. FIG. 17 is a flow chart diagram showing one example of game operations in the horse race gaming machine 1 of this embodiment. It is to be noted that respective stations 101 perform similar game operations respectively in cooperation with the racing game unit 11. In order to avoid any complication, however, only one station 101 is shown in FIG. 17.

The racing game unit 11 performs respective operations from S1001 to S1006.

First, in S1001, the main control unit 12 executes a racing game preparation process. In this process, for this racing game which constitutes a horse racing game, the CPU 41 determines a track, starter horse, start time, etc, and reads data on them from the ROM 43.

In S1002, the main control unit 12 transmits racing game information. In this transmission, the CPU 41 transmits respective data on the track, starter horse, start time, etc. of this racing game to each station 101, as racing game information.

In S1003, the main control unit 12 determines whether or not the present time is race start time of the racing game. In this determination, the CPU 41 checks time until the time to start this racing game is reached (S1003: NO).

The CPU 41 may also determine whether or not the present time is the time to start this racing game, by timing an interval from the last racing game.

When the time to start this racing game is reached (S1003: YES), the process proceeds to S1004 and the main control unit 12 executes a racing game display process. In this process, based on the determination in S1001 above, the CPU 41 not only displays race images of this racing game on the main monitor 21 but also outputs sound of this racing game from the speakers 22.

In S1005, the main control unit 12 executes a racing game result process. In this process, the CPU 41 calculates a payout amount of the respective stations 101, based on the racing game result in S1004 above and BET information transmitted by the respective stations 101 in S105 below, etc.

In S1006, the main control unit 12 transmits racing game payout information. In this transmission, the CPU 41 transmits to the respective corresponding stations 101 respective payout amounts, etc. in S1005 above, as racing game payout information.

In this time, the main control unit 12 adds the racing game result in S1004 above to the racing game payout information. The racing game result is included in the racing game payout information in a data format in which order of arrival, times, etc. are associated with each of the character IDs of the racehorses.

Thereafter, similar processes are also repeated in the next racing game.

Meanwhile, in the respective stations 101, respective operations of S101 to S107 are performed.

Figure 20:
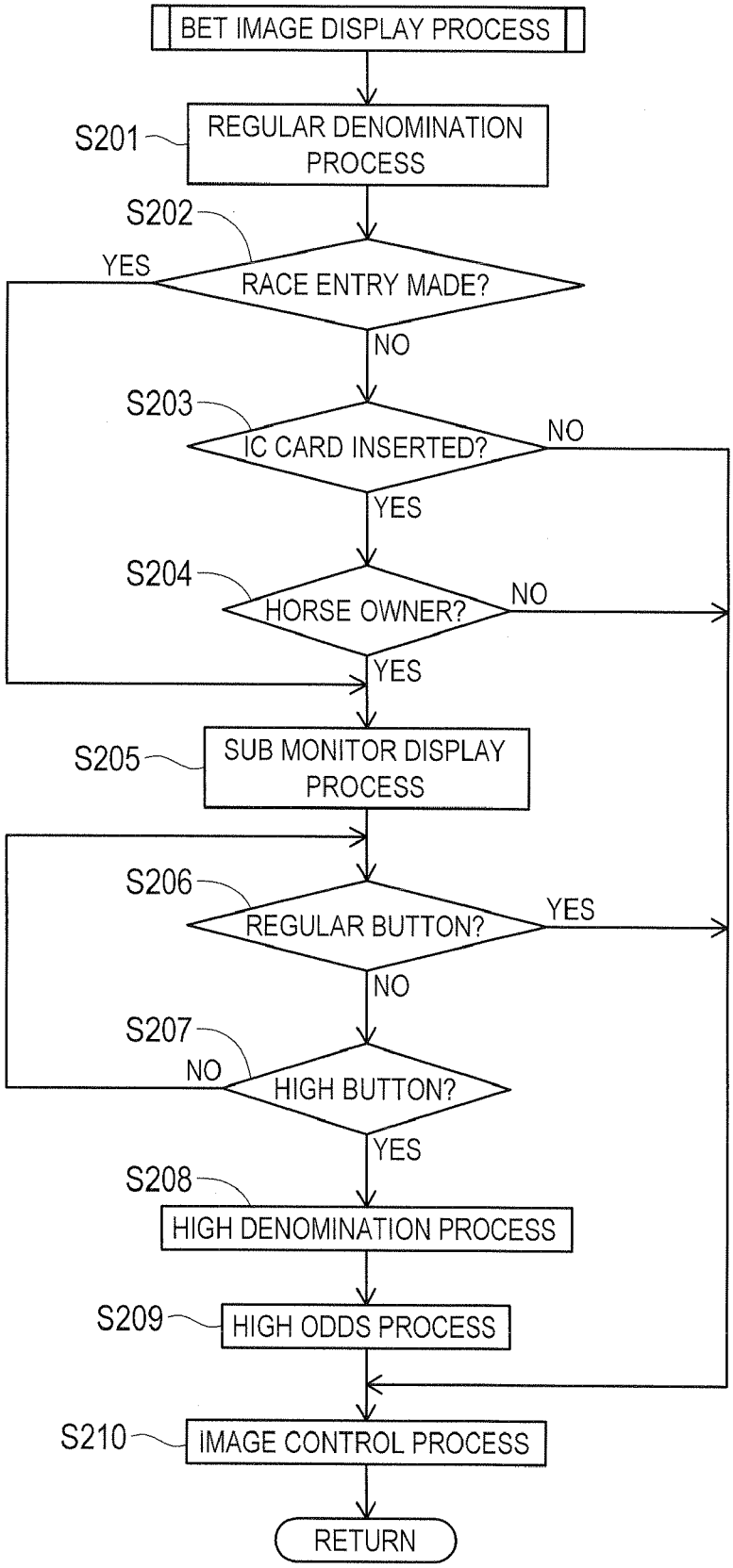
FIG. 20 is a flow chart diagram showing one example of game operations in the horse race gaming machine.

First, in S101, the sub control unit 102 executes a BET image display process. The respective stations 101 execute the BET image display process based on the flow chart of FIG. 20.

Figure 6:
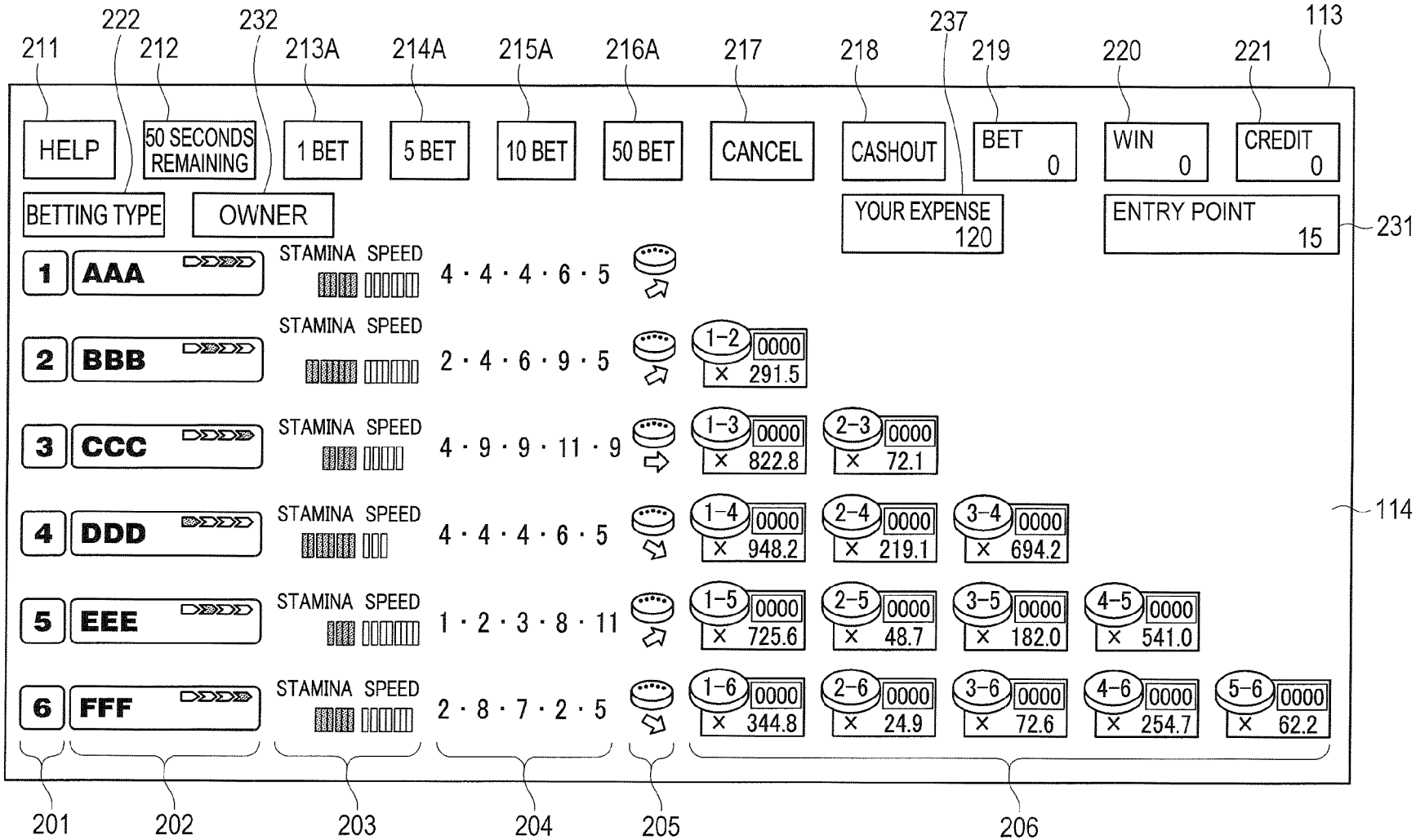
FIG. 6 is a front view showing one example of a regular BET image displayed on a sub monitor.

First, in S201, the sub control unit 102 executes a regular denomination process. In this process, the CPU 131 displays a regular BET image of this racing game on the sub monitor 113, based on the data related to the racing game information transmitted by the racing game unit 11 in S1002 above. FIG. 6 shows one example of the regular BET image displayed on the sub monitor 113.

As shown in FIG. 6, in a regular BET image displayed on the screen of the sub monitor 113 covered by the light transmissive colorless touch panel 114 are provided a horse number display area 201, a horse name display area 202, a basic power display area 203 that displays speed and stamina by a bar graph, a performance display area 204 that displays orders of arrival in last five races, a brief comment display area 205 that displays the condition of this racing game by an arrow, a betting ticket purchase button display area 206 where a betting ticket purchase button of a quinella-type bet in which a player randomly picks a combination of horse numbers that will finish in the first place and in the second place in order to win, odds or BET amounts are displayed together, etc.

In addition, in the regular BET image are provided a help button 211, a time display area 212, a 1 BET button 213A, a 5 BET button 214A, a 10 BET button 215A, a 50 BET button 216A, a cancel button 217, a CASHOUT button 218, a BET amount display area 219, a payout amount display area 220, a credit amount display area 221, a betting ticket type switch button 222, an owner button 232, an entry point display area 231, an expense display area 237, etc.

The help button 211 is a button that a player touches to display a method of BET operation, etc. on the sub monitor 113. The time display area 212 displays BET time in terms of the remaining time. The 1 BET button 213A is a button that a player touches to set so that "1" is added to the present BET amount. The 5 BET button 214A is a button that a player touches to set so that "5" is added to the present BET amount. The 10 BET button 215A is a button that a player touches to set so that "10" is added to the present BET amount. The 50 BET button 216A is a button that a player touches to set so that "50" is added to the present BET amount. Accordingly, the denomination of the regular BET image is "1". In other words, the minimum bet amount that a player can specify in the regular BET image is "1".

The cancel button 217 is a button that a player touches to cancel the setting of addition to the BET amount. The CASHOUT button 218 is a button that a player touches to be paid out the number of coins corresponding to a player's own credit amount in bar coded tickets printed by the ticket printer 116. The BET amount display area 219 displays the total BET amount that a player sets for this racing game. The payout amount display area 220 displays a payout amount of this racing game. The credit amount display area 221 displays a player's own credit amount.

Touching any of the betting ticket purchase buttons within the betting ticket purchase button display area 206 after touching any of the respective BET buttons 213A, 214A, 215A, and 216A, a player can perform the BET operation of the quinella-type bet. For example, if a player touches the betting ticket purchase button for "1-2" in the betting ticket purchase button display area 206 after touching the 10 BET button 215A, the player can set addition of "10" to the present BET amount for a combination of No. 1 and No. 2, as a combination of horse numbers that the player forecasts will finish in the first or second places in no particular order. The present BET amount for respective combinations of horse numbers are displayed next to the betting ticket purchase buttons corresponding to the respective combinations.

Although the regular BET image shown in FIG. 6 is for the quinella-type bet, such respective types of betting as win, place, bracket quinella, quinella place, exacta, trio, trifecta, etc. are also available, and every time a player touches the betting ticket type switch button 222, the regular BET image changes to a regular BET image of a different type.

Various data in the regular BET image such as horse names and odds, etc. is included in data on the racing game information transmitted by the racing game unit 11 in S1002 above.

The owner button 232 is a button that a player touches when he/she wants to purchase a racehorse. The entry point display area 231 displays entry points owned by a player. The expense display area 237 displays an accumulated amount of the expense that was paid about that a player is an owner of a racehorse.

Returning to FIG. 20, in S202, the sub control unit 102 determines whether or not a race entry has been made. In this determination, the CPU 131 makes a determination based on the data related to race entry information stored in the RAM 132, etc. described later. Then, if the race entry has been made (S202: YES), the process proceeds to S205 below. In this case (S202: YES), the player is an owner of any racehorse. The player has also made the race entry of his/her own racehorse in any racing game. In contrast, if the race entry has not been made (S202: NO), the process proceeds to S203.

In S203, the sub control 102 determines whether or not an IC card 119 is inserted into the reader/writer 118. In this determination, the CPU 131 makes a determination based on the data on whether or not there is an IC card 119 transmitted by the reader/writer 118, etc. Now if an IC card 119 is not inserted into the reader/writer 118 (S203: NO), the process proceeds to S210 below. In contrast, if an IC card 119 is inserted into the reader/writer 118 (S203: YES), the process proceeds to S204.

In S204, the sub control unit 102 determines whether or not a player is an owner of any racehorse. In this determination, the CPU 131 makes a determination based on the data on horse owner information 501 (refer to FIG. 15 below) stored in the RAM 132 or an IC card 119, etc. The horse owner information 501 (refer to FIG. 15 below) stored in an IC card 119 is read out by the reader/writer 118 and inputted into the CPU 131. Now, if a player is not an owner of any racehorse (S204: NO), the process proceeds to S210 below. In contrast, if the player is an owner of any racehorse (S204: YES), the process proceeds to S205.

Figure 7:
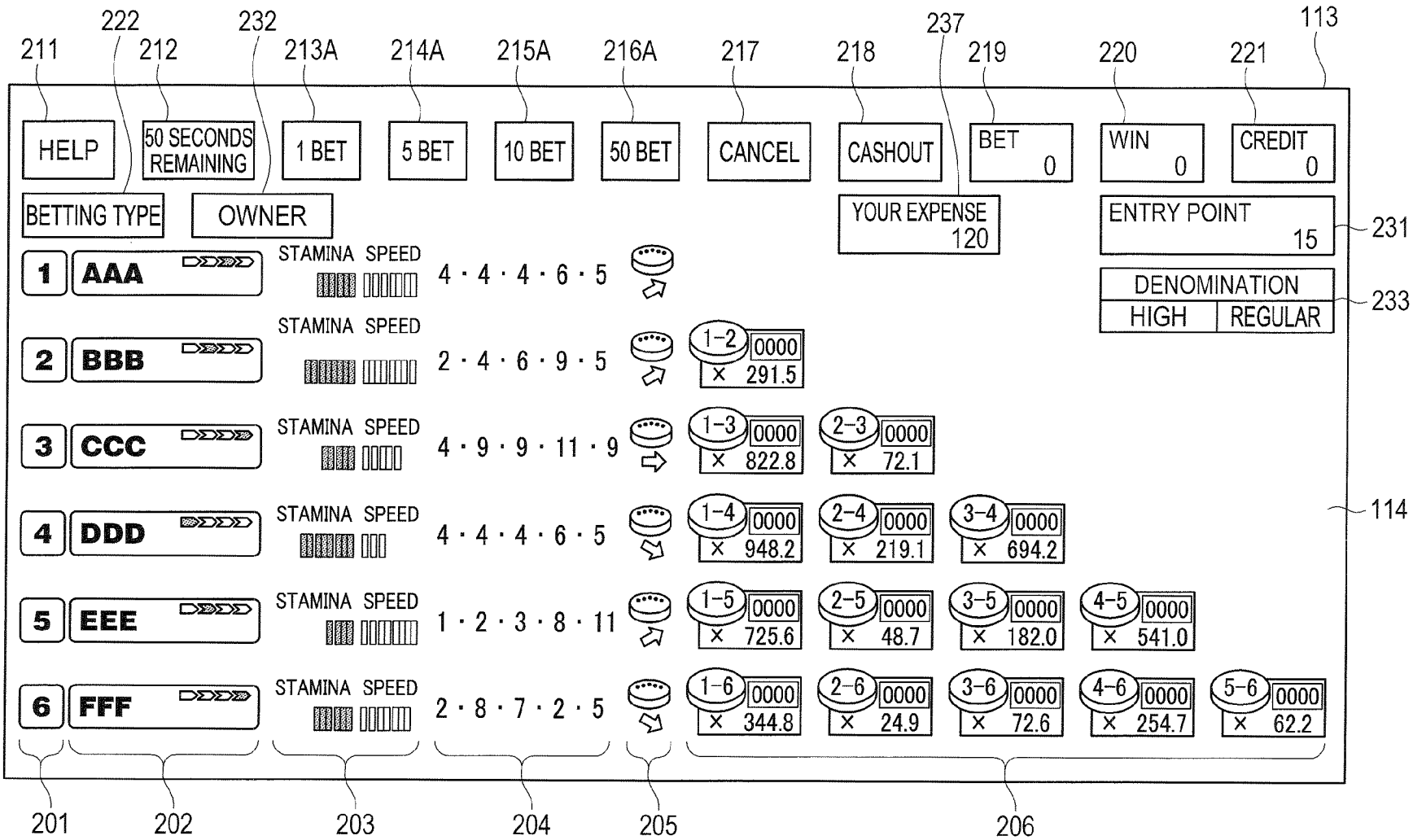
FIG. 7 is a front view showing one example of the regular BET image displayed on the sub monitor.

In S205, the sub control unit 102 executes a sub monitor display process. In this process, the CPU 131 changes the regular BET image being displayed on the sub monitor 113 to a regular BET image as shown in FIG. 7. In other words, a denomination button 233 is synthesized and displayed on the regular BET image as shown in FIG. 6. The denomination button 233 includes a regular button and a high button.

In S206, the sub control unit 102 determines whether or not a player has touched the regular button. In this determination, based on a coordinate signal from the touch panel driving circuit 122, the CPU 131 determines whether or not the player has touched the regular button included in the denomination button 233. Now, if the player has touched the regular button (S206: YES), the process proceeds to S210 below. In contrast, if the player has not touched the regular button (S206: NO), the process proceeds to S207.

In S207, the sub control unit 102 determines whether or not the player has touched the high button. In this determination, based on a coordinate signal from the touch panel driving circuit 122, the CPU 131 determines whether or not the player has touched the high button included in the denomination button 233. Now, if the player has not touched the high button (S207: NO), the process returns to S206 above. In contrast, if the player has touched the high button (S207: YES), the process proceeds to S208.

In other words, the respective determination processes of S206 and S207 above are repeated until the player touches either the regular button or the high button included in the denomination button 233. However, similar to the determination process in S103 below, the sub control unit 102 determines whether or not the BET time has elapsed even while the respective determination processes of S206 and S207 above are being repeated. If the sub control unit 102 determines that the BET time has elapsed before the player touches either the regular button or the high button included in the denomination button 233, the process is forced to proceed to S210 below.

Figure 8:
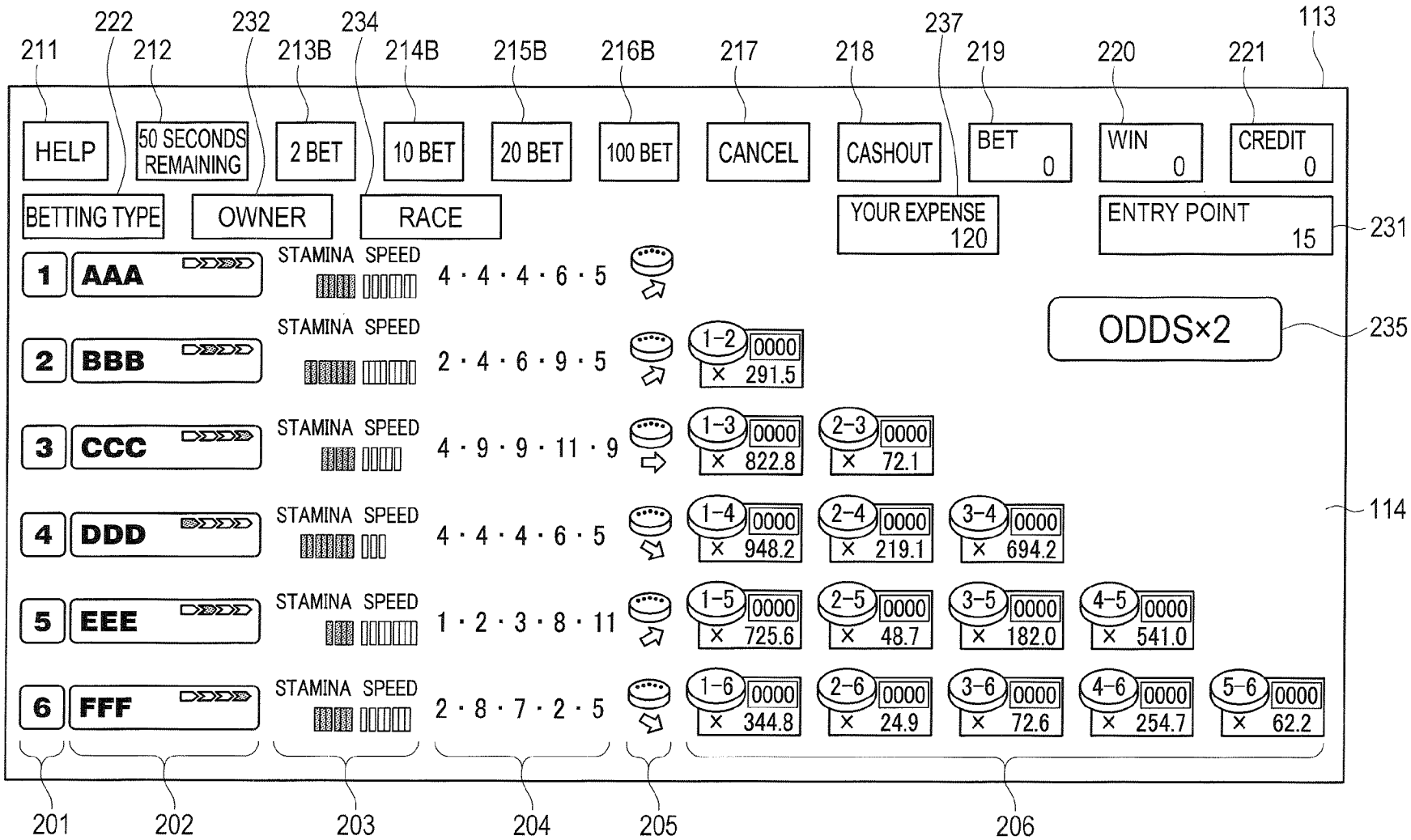
FIG. 8 is a front view showing one example of a high BET image displayed on the sub monitor.

In S208, the sub control unit 102 executes a high denomination process. In this process, the CPU 131 displays a high BET image of this racing game on the sub monitor 113. FIG. 8 shows one example of the high BET image displayed on the sub monitor 113.

In the high BET image are provided a 2 BET button 213B, a 10 BET button 214B, a 20 BET button 215B, and a 100 BET button 216B. Thus, in the high BET image, the bet amounts of the respective BET buttons are twice as large as those in the regular BET image (refer to FIG. 6 and FIG. 7 above). Accordingly, the denomination of the high BET image is "2". In other words, the minimum bet amount that a player can specify in the high BET image is "2". In contrast, the minimum bet amount that a player can specify in the regular BET image (refer to FIG. 6 and FIG. 7 above) is "1". Accordingly, the denomination of the high BET image is twice the denomination of the regular BET image (refer to FIG. 6 and FIG. 7 above).

In addition, in the high BET image are provided a race button 234 or a message display area 235. The race button 234 is a button that a player touches when he/she wishes to make a race entry of his/her own racehorse in a racing game. The message display area 235 displays a message ("ODDS×2") indicating that odds will be twice as large as those in the regular BET image (refer to FIG. 6 and FIG. 7 above).

Except for these points, the high BET image is same as the regular BET image (refer to FIG. 6 above), and thus details thereof are omitted.

In S209, the sub control unit 102 executes a high odds process. In this process, the CPU 131 stores in the RAM 132 the data showing that the odds are doubled, in order to have it included in BET information to be transmitted to the racing game unit 11 in S105 below.

In S210, the sub control unit 102 executes an image control process. In this process, the CPU 131 performs necessary other display controls over the regular BET image or the high BET image displayed on the sub monitor 113. Thereafter, the process proceeds to S102 of FIG. 6.

Returning to FIG. 17, in S102, the sub control unit 102 executes a BET operation acceptance process. In this process, based on a coordinate signal from the touch panel driving circuit 122, the CPU 131 identifies the content of the player's BET operation for this racing game and stores it in the RAM 132. The CPU 131 also checks time when each BET operation is performed and stores it in the RAM 132. The CPU 131 reflects the content of the player's BET operation in the display of the BET images of the sub monitor 113.

In S103, the sub control unit 102 determines whether or not the BET time has elapsed. In this determination, the CPU 131 checks time until the BET time has elapsed. The BET time is computed by the CPU 131 based on the data on the racing game information transmitted by the racing game unit 11 in S1002 above, and begins before this racing game starts and ends at predetermined timing while this racing game is in progress.

In addition, the sub control unit 102 may determine that the BET time has elapsed, when the remaining time displayed in the time display area 212 on the regular BET image or the high BET image of the sub monitor 113 runs out.

Till the BET time elapses (S103: NO), the sub control unit 102 returns to S102 above, and continues with the BET operation acceptance process. When the BET time has elapsed (S103: YES), the process proceeds to S104 and the sub control unit 102 determines whether or not there is a BET. In this determination, the CPU 131 determines whether or not there is a BET setting for this racing game based on what is stored in S102 above.

Only when the sub control unit 102 determines that there is a BET (S104: YES), the process proceeds to S105 and the sub control unit 102 transmits BET information. In this transmission, the CPU 131 transmits to the racing game unit 11 the data on the memory content in S209 or S102 above, as BET information.

In S106, the sub control unit 102 executes an entry point increasing process. In this process, the CPU 131 updates the player's own entry points stored in the RAM 132, by adding points corresponding to the content of the player's BET operation on this racing game to the player's own entry points. The added entry points are equal to a certain proportion of the total BET amount the player sets for this racing game. The CPU 131 displays the entry points after the addition in the entry point display area 231 on the regular BET image or the high BET image of the sub monitor 113.

In S107, the sub control unit 102 executes a racing game payout process. In this process, based on the data on the racing game payout information transmitted by the racing game unit 11 in S1006 above, the CPU 131 updates not only the player's own credit amount stored in the RAM 132, but also the display in the payout amount display area 220 or the credit amount display area 221 on the regular BET image or the high BET image of the sub monitor 113.

Further, in the respective stations 101, the main control unit 12 executes respective processes described in the flow chart of FIG. 1 at the time point P1 after S107 is executed.

First, in S501, the sub control unit 102 executes a performance point calculation process. In this process, the CPU 131 calculates a performance point for each of the player's racehorses.

In the sub control unit 102, a performance point of each of the player's racehorses is managed for this process by using a spread sheet, for example, a data table shown in FIG. 21. This data table stores the number of wins, the number of race, a winning percentage, best time, and a performance point for each of the player's racehorses. Such as a data table is generated for each of player IDs and stored into the RAM 132, etc.

The number of wins represents the number of racing games in which the racehorse won. The number of races represents the number of racing games in which the racehorse ran. A winning percentage is the percentage obtained by dividing the number of races by the number of wins. Best time is the shortest time at which the racehorse ran in a predetermined track. A performance point represents the total of points calculated based on the references individually set to the number of wins, the number of races, a winning percentage and best time. The number of wins, the number of races, a winning percentage, best time and a performance point are stored in the data table, associated with the character ID of each of the player's racehorses.

When calculating the performance point on each of the player's racehorses in this process, the CPU 131 reflects the racing game result of this racing game in the data table associated with the player by means of a spread sheet program constructed by using a character ID and a player ID, etc.

Incidentally, the racing game result of this racing game is included in the racing game payout information transmitted by the racing game unit 11 in S1006 in FIG. 17 above. Additionally, the CPU 131 has already identified the player ID of the player through S202, S203, S204, etc. in FIG. 20 above.

In S502, the sub control unit 102 determines whether or not each of the player's racehorses satisfies a predetermined condition. In this determination, the CPU 131 determines by using a data table as shown in FIG. 22 and the data table of FIG. 21 above. More precisely, if the performance point calculated in S501 above reaches any of the reference points in the data table of FIG. 22, "10", "100", "300", "500", "700", "900" and "1000" for the first time, it will be determined that the player's racehorse satisfies the predetermined condition.

Incidentally, the data table of FIG. 22 is stored in the ROM 133, etc.

Also, for making it possible to determine whether or not the performance point reaches the said reference point for the first time, if there is such a racehorse of which performance point reaches the reference point for the first time, the CPU 131 adds data to the data table of FIG. 21 above, with which such the racehorse and the reference point can be identified.

Now, if the player's racehorse does not satisfy the predetermined condition (S502: NO), the game operations described in the flow chart of FIG. 1 is terminated to return to the game operations described in the flow chart of FIG. 17. In contrast, if the player's racehorse satisfies the predetermined condition (S502: YES), the process proceeds to S503.

In S503, the sub control unit 102 executes an expense refund process. In this process, the CPU 131 transmits expense refund request information to the racing game unit 11. In this time, the player ID of the player, data showing the requesting of a refund of the collected expense amount of the player, etc. are included in the expense refund request information by the CPU 131.

Meanwhile, in the racing game unit 11, the CPU 41 transmits in reply refund-expense-amount award information including data showing the total of the collected expense amount of the player ID included in the expense refund request information.

As described later, the collected expense amount is stored in the RAM 42 or the external memory device 25, etc. and is provided for each of player IDs. In the collected expense amount, a credit amount which is required of a player to purchase a racehorse (S309, S312 in FIG. 18 below) and a credit amount which is required of a player to make a race enter in a racing game for the player's racehorse (S413, S414 in FIG. 19 below) are included. Incidentally, the CPU 41 updates with "0" the collected expense amount of the subject player ID when transmitting the refund-expense-amount award information in reply.

In the sub control unit 102, the CPU 131 updates not only the player's credit amount stored in the RAM 132, but also the display in the payout amount display area 220 or the credit amount display area 221 on the regular BET image or high BET image of the sub monitor 113, based on the data showing the total of the collected expense amount included in the refund-expense-amount award information. Further, the CPU 131 updates with "0" the display in the expense display area 237 on the regular BET image or high BET image of the sub monitor 113.

After that, the game operations described in the flow chart of FIG. 1 is terminated to return to the game operations described in the flow chart of FIG. 17.

[6. Example of Operations for Becoming a Racehorse Owner]

In the following, an example of operations for becoming a racehorse owner in the horse race gaming machine 1 of this embodiment is described. FIG. 18 is a flow chart diagram showing one example of an owner process.

Figure 18:
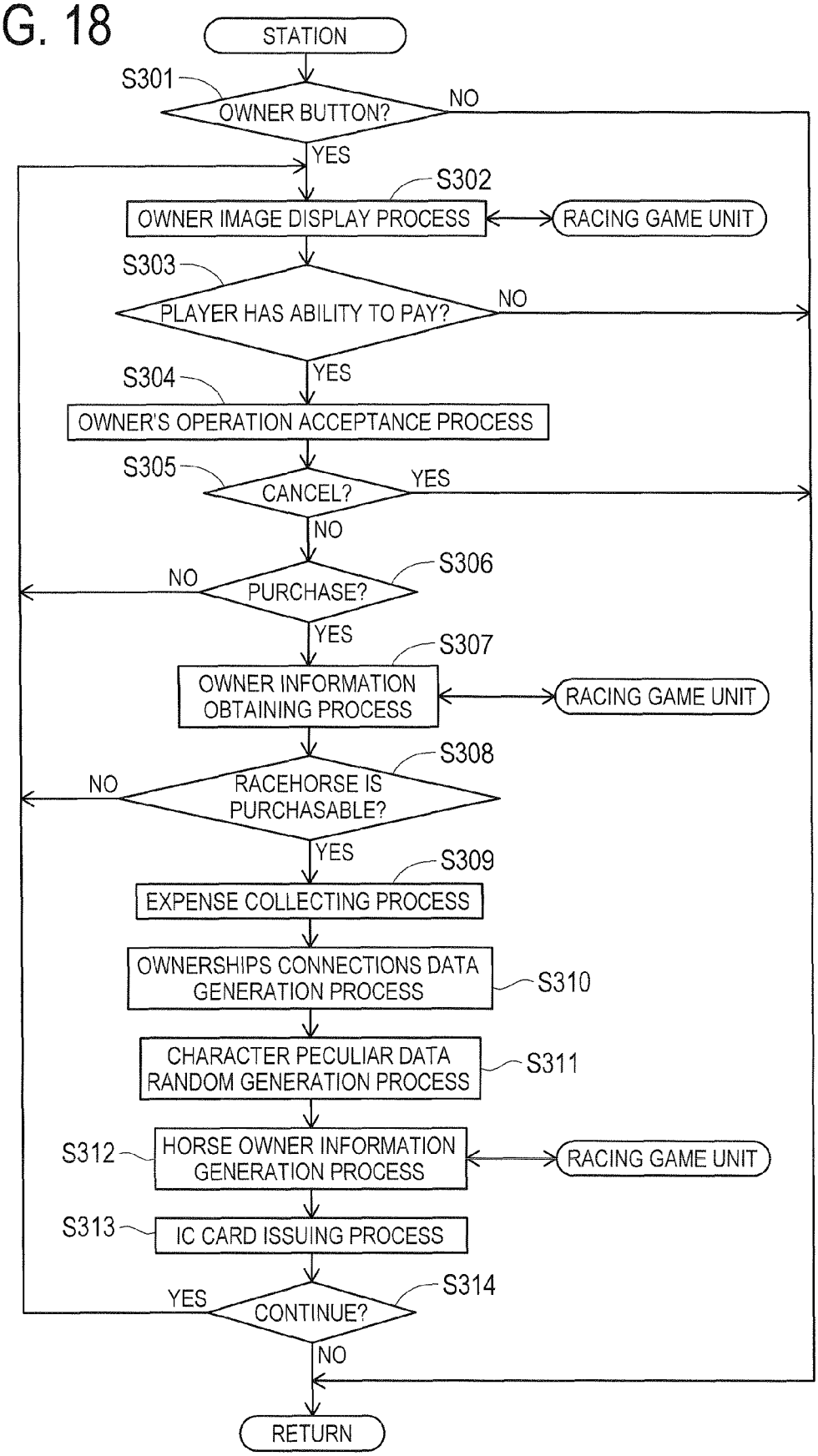
FIG. 18 is a flow chart diagram showing one example of an owner process.

In the respective stations 101, triggered by a player's touching the owner button 232 on the regular BET image or the high BET image of the sub monitor 113, the owner process is executed based on the flow chart of FIG. 18.

First, in S301, the sub control unit 102 determines whether or not the player has touched the owner button 232. In this determination, the CPU 131 determines whether or not the player has touched the owner button 232, based on a coordinate signal from the touch panel driving circuit 122. Now, if the player has not touched the owner button 232 (S301: NO), this owner process terminates. In contrast, if the player has touched the owner button 232 (S301: YES), the process proceeds to S302.

Figure 9:
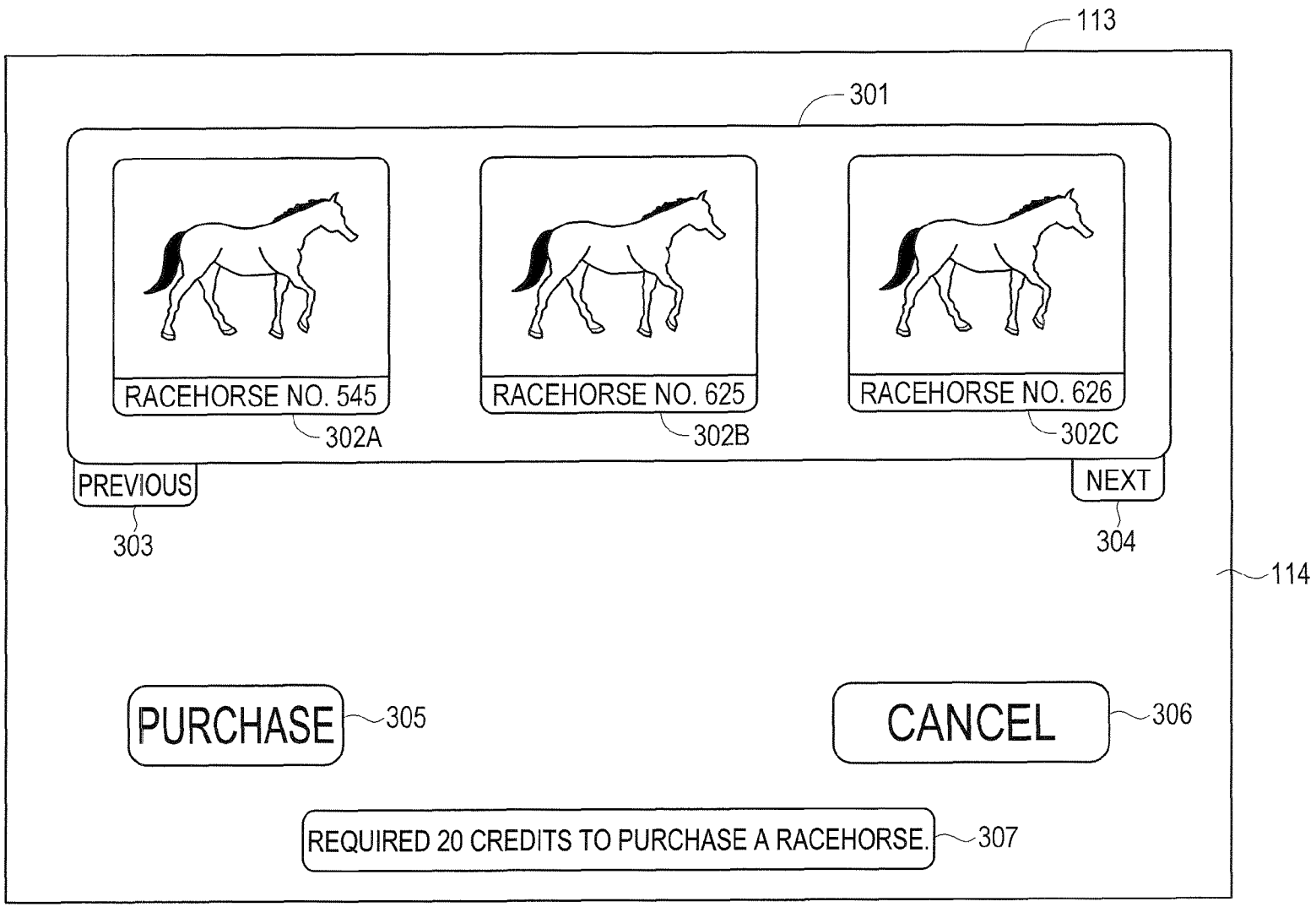
FIG. 9 is a front view showing one example of an owner image displayed on the sub monitor.

In S302, the sub control unit 102 executes an owner image display process. In this process, the CPU 131 displays an owner image on the sub monitor 113 based on the data on owner image information received through bidirectional communication with the racing game unit 11. FIG. 9 shows one example of the owner image displayed on the sub monitor 113.

As shown in FIG. 9, in the owner image displayed on the sub monitor 113 covered by the light transmissive colorless touch panel 114 are provided a racehorse page display area 301, a previous page button 303, a next page button 304, a purchase button 305, a cancel button 306 and a message display area 307, etc.

Three racehorse designation buttons 302A, 302B, and 302C are provided in the racehorse page display area 301. The respective racehorse designation buttons 302A, 302B, and 302C display videos of racehorses that a player can purchase and their respective designation numbers. A player can designate a racehorse that he/she wishes to purchase, by touching each racehorse designation button 302A, 302B and 302C.

In the racehorse page display area 301, video of the 3 racehorses that a player can purchase is displayed. If the number of racehorses that a player can purchase is more than 3, a plurality of the racehorse page display areas 301 will be generated. By touching the previous page button 303 or the next page button 304, a player can display any of the plurality of racehorse display areas 301 on the owner image of the sub monitor 113.

It is to be noted that the data on racehorses that a player can purchase is included in the owner image information received through bidirectional communication with the racing game unit 11 in S302 above.

The purchase button 305 is a button that a player touches when determining a purchase of the designated racehorse. The cancel button 306 is a button that a player touches when aborting a purchase of a racehorse. The message display area 307 displays the message "REQUIRED 20 CREDITS TO PURCHASE A RACEHORSE".

In S303, the sub control unit 102 determines whether or not the player has the ability to pay. As shown in the message displayed in the message display area 307, in this embodiment, 20 credits are required to purchase a racehorse. Therefore, in this determination, the CPU 131 determines that the player has the ability to pay if the player's own credit amount stored in the RAM 132 is not less than 20 credits. If the player has no ability to pay (S303: NO), this owner process terminates. In contrast, if the player has the ability to pay (S303: YES), the process proceeds to S304.

In S304, the sub control unit 102 executes an owner's operation acceptance process. In this process, the CPU 131 identifies the content of the player's BET operation in the owner image of the sub monitor 113, based on a coordinate signal from the touch panel driving circuit 122, and stores it in the RAM 132. The CPU 131 reflects the content of the player's BET operation in the display of the owner image of the sub monitor 113.

In S305, the sub control unit 102 determines whether or not the player has touched the cancel button 306. In this determination, the CPU 131 determines whether or not the player has touched the cancel button 306 based on a coordinate signal from the touch panel driving circuit 122. Now, if the player has touched the cancel button 306 (S305: YES), this owner process terminates. In contrast, if the player has not touched the cancel button 306 (S305: NO), the process proceeds to S306.

In S306, the sub control unit 102 determines whether or not the player has touched the purchase button 305. In this determination, the CPU 131 determines whether or not the player has touched the purchase button 305 based on a coordinate signal from the touch panel driving circuit 122. Now, if the player has not touched the purchase button 305 (S306: NO), the process returns to S302 above. In contrast, if the player has touched the purchase button 305 (S306: YES), the process proceeds to S307.

In S307, the sub control unit 102 executes an owner information obtaining process. In this process, the CPU 131 receives owner information through bidirectional communication with the racing game unit 11. This owner information includes data obtained as a result of causing the racing game unit 11 to check whether or not the racehorse designated by the player is purchasable. If the racehorse is purchasable, the racing game unit 11 puts the racehorse into purchase reserved state to prevent other player from purchasing the racehorse.

Figure 13:
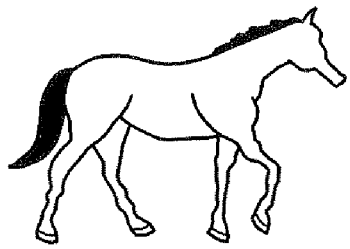
FIG. 13 is a view showing one example of a data table.
Figure 13:
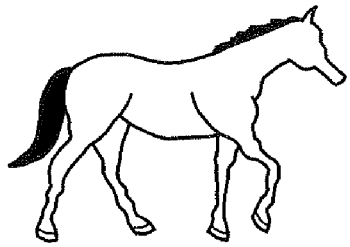
Figure 13:
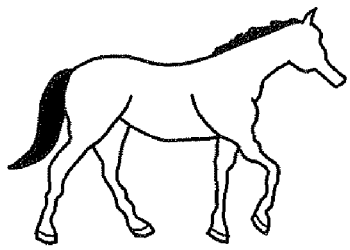

In the racing game unit 11, the CPU 41 controls respective racehorses by means of a character ID. For example, as per the data table shown in FIG. 13, the racehorses are associated with the character IDs. Such the table is stored in the RAM 42 or the external memory device 25, etc.

In addition, by associating the character IDs with player IDs, the racing game unit 11 determines whether or not a racehorse is purchasable. For example, as per the data table shown in FIG. 14, the character IDs are associated with the player IDs. Such the data table is stored in the RAM 42 or the external storage unit 25, etc.

By referring to an association between the character IDs and the player IDs, the racing game unit 11 can also determine whether or not a player identified by the player ID is an owner of any racehorse. In addition, in the purchase reserved state described above, in the data table as shown in FIG. 14, for example, the racing game unit 11 controls so that the character ID of the racehorse to be reserved can only be associated with the player ID of the player of that particular reservation.

In S308, the sub control unit 102 determines whether or not the racehorse designated by the player is purchasable. In this determination, the CPU 131 makes a determination based on the data on the owner information received in S307 above. Now, if the racehorse designated by the player is not purchasable (S308: NO), the process returns to S302 above. In contrast, if the racehorse designated by the player is purchasable (S308: YES), the process proceeds to S309.

In S309, the sub control unit 102 executes an expense collecting process. In this process, by deducting credit amounts necessary for purchasing a racehorse from the player's own credit amount, the CPU 131 updates not only the player's own credit amount stored in the RAM 132 but also the display in the credit amount display area 221 on the regular BET image or high BET image of the sub monitor 113.

In S310, the sub control unit 102 executes an ownerships connections data generation process. In this process, the CPU 131 generates a player ID according to predetermined rules. However, if an IC card 119 is inserted into the reader/writer 118, the CPU 131 uses the player ID included in horse owner information 501 (refer to FIG. 15 below) of the IC card 119. In addition, the CPU 131 links a character ID of a racehorse of the purchase object with its player ID.

In S311, the sub control unit 102 executes a character peculiar data random generation process. In this process, using random numbers, the CPU 131 generates character peculiar data on characters of a racehorse of the purchase object.

Figures 14, 15:
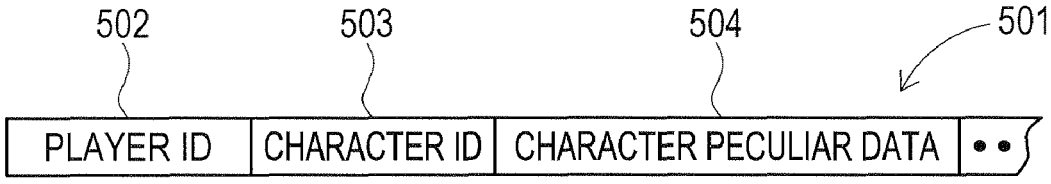
FIG. 14 is a view showing one example of a data table.
FIG. 15 is a view showing one example of horse owner information.

In S312, the sub control unit 102 executes a horse owner information generation process. In this process, the CPU 131 generates horse owner information 501 as shown in FIG. 15. In the horse owner information 501, the character peculiar data generated in S311 above is linked with the character ID and the player ID thereof that were linked to each other in S310 above. In other words, the horse owner information 501 includes the data 502 on player ID generated in S310 above, the data 503 on the character ID of the racehorse of the purchase object, and the character peculiar data 504 generated in S311 above.

When the horse owner information 501 is stored in the RAM 132 by the CPU 131, it is transmitted to the racing game unit 11 at the same time. Further, the CPU 131 adds data showing a credit amount which is required to purchase a racehorse to the horse owner information 501 when transmitting the horse owner information 501.

Meanwhile, in the racing game unit 11, the CPU 41 stores the horse owner information 501 in the RAM 42 or the external memory device 25, etc. In addition, in the racing game unit 11, the CPU 41 associates character IDs with player IDs based on the horse owner information 501. Further, in the racing game unit 11, the CPU 41 includes a credit amount which is required to purchase a racehorse in the collected expense amount, based on the data added to the horse owner information 501. The collected expense amount is stored in the RAM 42 or the external memory device 25, etc. and is provided for each of player IDs. Accordingly, the CPU 41 includes a credit amount which is required to purchase a racehorse in the collected expense amount of the player ID identified by the horse owner information 501. Thereafter, in the racing game unit 11, the CPU 41 transmits in reply collected expense amount information. Thereafter, in the racing game unit 11, the CPU 41 transmits in reply collected expense amount information. In this time, the CPU 41 adds data showing the collected expense amount after the inclusion to the collected expense amount information.

On the other hand, in the sub control unit 102, when a regular BET image or high BET image is displayed on the sub monitor 113, the CPU 131 controls so as to update the display in the expense display area 237, based on the data showing the collected expense amount included in the collected expense amount information.

In S313, the sub control unit 102 executes an IC card issuing process. In this process, the CPU 131 causes the IC card issuing device 117 to issue an IC card 119 storing the horse owner information 501.

In S314, the sub control unit 102 determines whether or not to continue operation in the owner image of the sub monitor 113. Now, if a player touches any part of the owner image within a predetermined period of time from when the IC card issuing device 117 is caused to issue an IC card 119, the CPU 131 determines that the operation continues in the owner image of the sub monitor 113. Therefore, in this determination, the CPU 131 determines whether or not the player has touched any part of the owner image of the sub monitor 113, based on a coordinate signal from the touch panel driving circuit 122. Now, if the operation continues in the owner image of the sub monitor 113 (S314: YES), the process returns to S302 above. In contrast, if the operation does not continue in the owner image of the sub monitor 113 (S314: NO), this owner process terminates.

Figure 10:
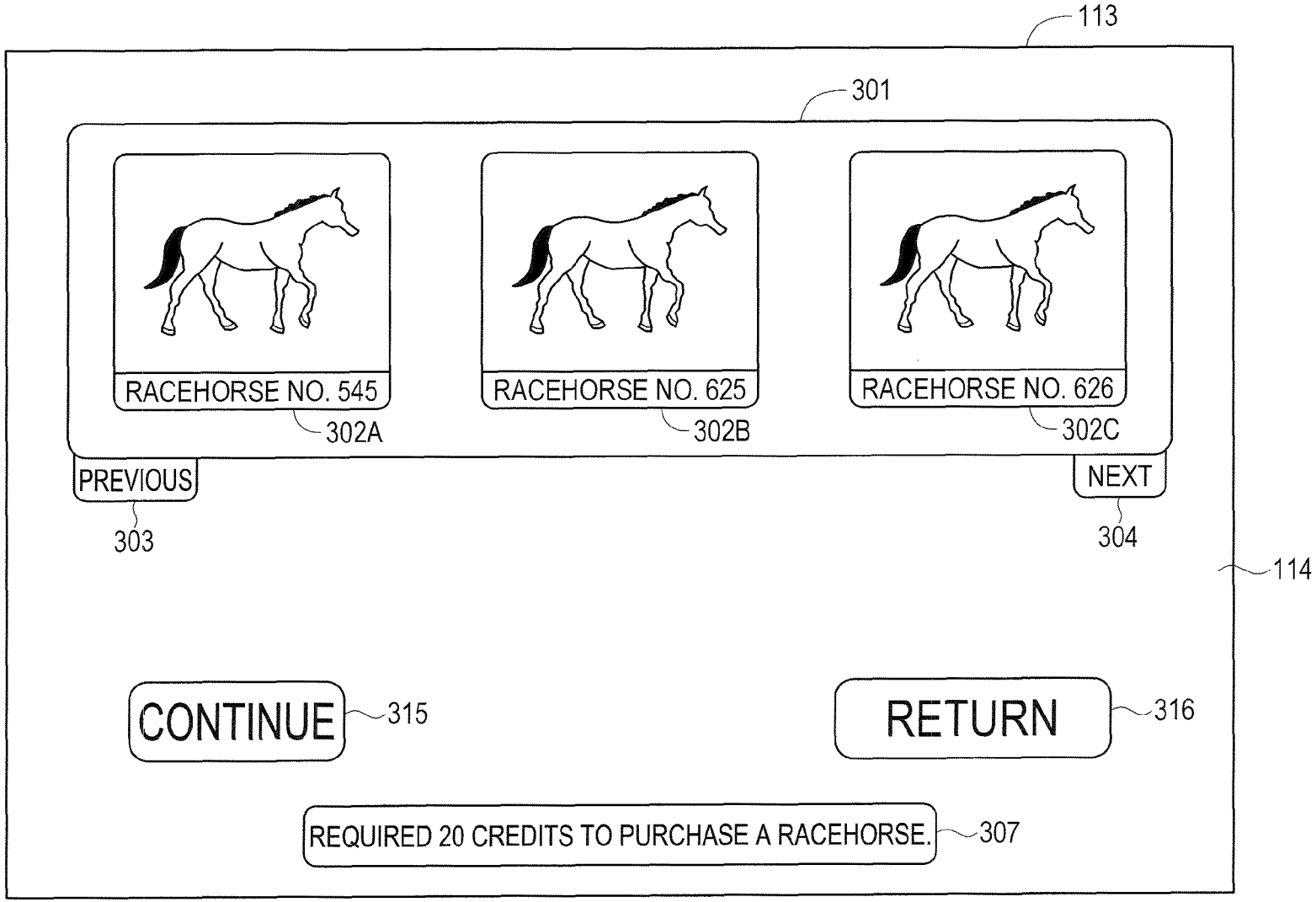
FIG. 10 is a front view showing one example of the owner image displayed on the sub monitor.

In this respect, the CPU 131 may be such configured that the process of this S314 is implemented, by providing a continue button 315 or a return button 316 in the owner image of the sub monitor 113, as shown in FIG. 10.

When this owner process terminates, the sub monitor 113 returns to the condition before this owner process starts. Therefore, the sub monitor 113 displays the regular BET image above or the high BET image above.

[7. Example of Operations for Making a Race Entry of a Player's Racehorse in a Racing Game]

In the following, the example of operations for making a race entry of a player's racehorse in a racing game in the horse race gaming machine 1 according to this embodiment is described. FIG. 19 is a flow chart diagram showing one example of an entry process.

Figure 19:
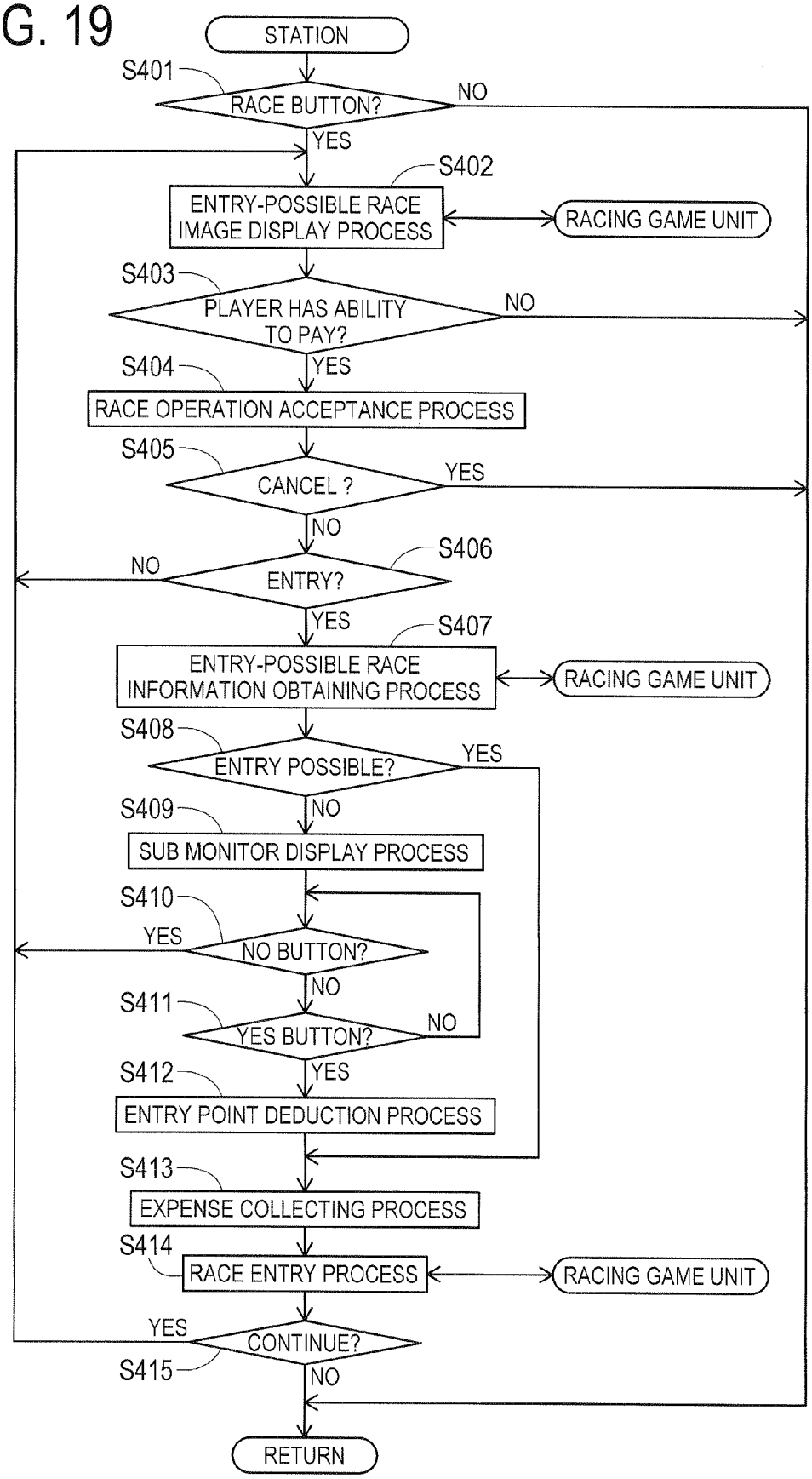
FIG. 19 is a flow chart diagram showing one example of an entry process.

In the respective stations 101, triggered by a player's touching the race button 234 on the high BET image of the sub monitor 113, the entry process is executed based on the flow chart of FIG. 19.

First, in S401, the sub control unit 102 determines whether or not a player has touched the race button 234. In this determination, the CPU 131 determines whether or not the player has touched the race button 234 based on a coordinate signal from the touch panel driving circuit 122. Now, if the player has not touched the race button 234 (S401: NO), this entry process terminates. In contrast, if the player has touched the race button 234 (S401: YES), the process proceeds to S402.

Figure 11:
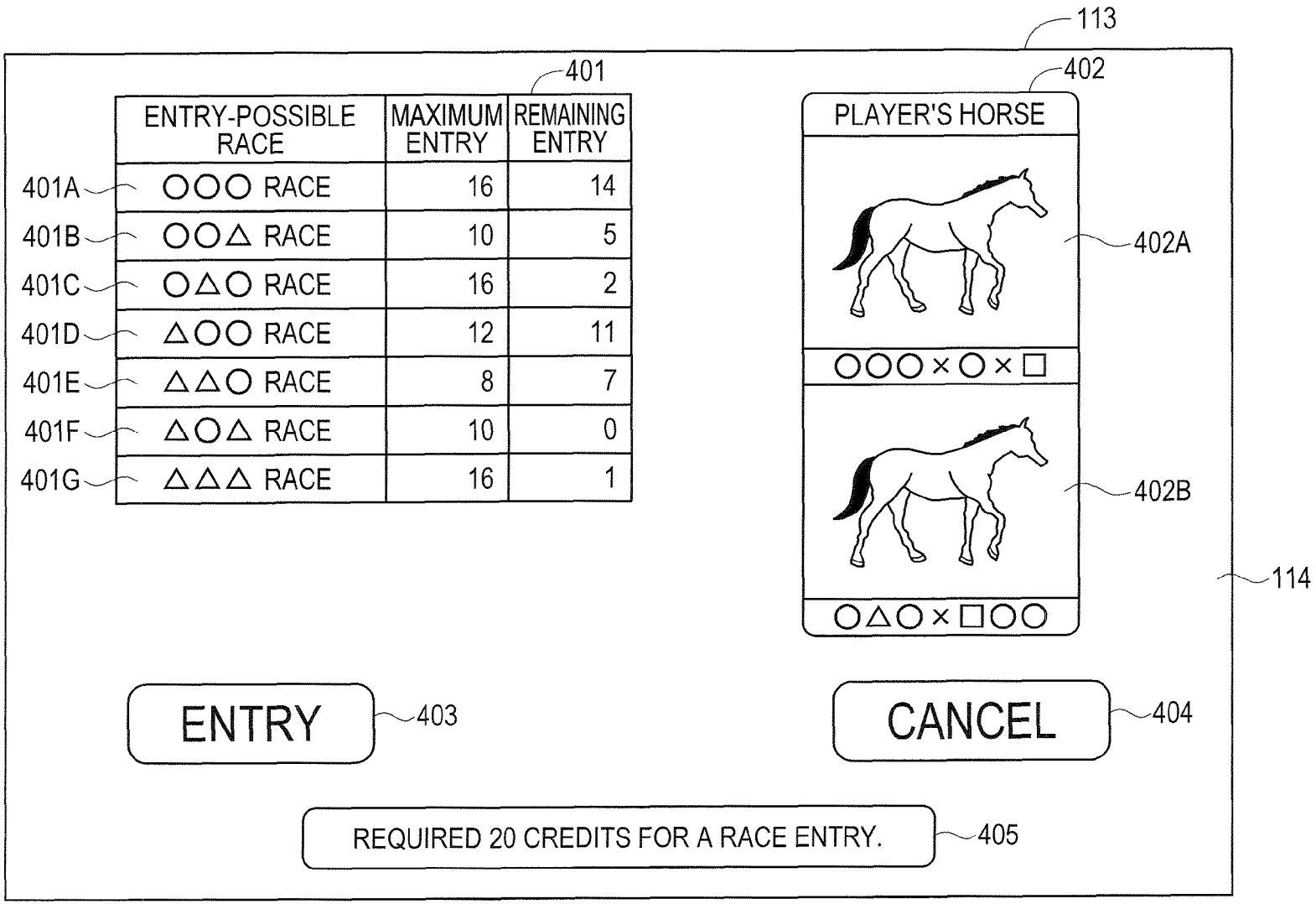
FIG. 11 is a front view showing one example of an entry-possible race image displayed on the sub monitor.
Figure 12:
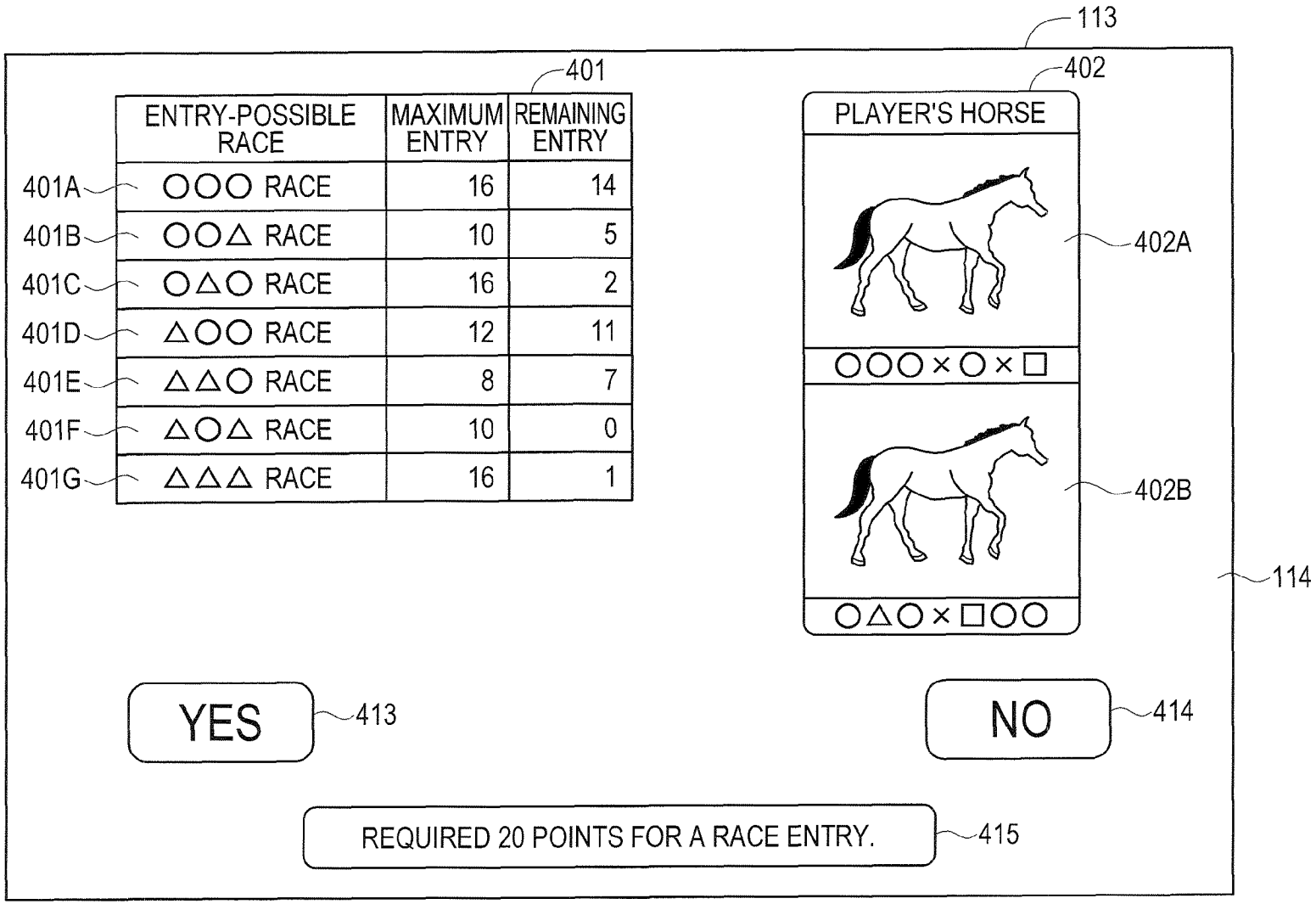
FIG. 12 is a front view showing one example of the entry-possible race image displayed on the sub monitor.

In S402, the sub control unit 102 executes an entry-possible race image display process. In this process, the CPU 131 displays an entry-possible race image on the sub monitor 113, based on the data on entry-possible race image information received through bidirectional communication with the racing game unit 11. FIG. 11 and FIG. 12 show one example of the entry-possible race image displayed on the sub monitor 113.

As shown in FIG. 11, in the entry-possible race image displayed on the sub monitor 113 covered by the light transmissive colorless touch panel 114 is provided an entry-possible race display area 401, a player's horse display area 402, an entry button 403, a cancel button 404 and a message display area 405, etc.

In the entry-possible race display area 401 is provided with respective columns for an entry possible race, a maximum entry, and a remaining entry. The entry possible race column displays a name of a racing game in which a race entry of a racehorse is possible. Parts where those names are displayed are used as designation buttons 401A, 401B, 401C, 401D, 401E, 401F, and 401G for a player to designate a racing game. The maximum entry column displays the number of racehorses that run in a racing game. The remaining entry column displays the number of racehorses that can make a race entry in a racing game.

The player's horse display area 402 displays racehorses whose owner is a player. Parts in which those racehorses are displayed are used as designation buttons 402A, 402B for a player to designate a racehorse.

The data on the entry-possible race display area 401 or the player's horse display area 402 is included in the entry-possible race image information received through bidirectional communication with the racing game unit 11 in S402 above.

The entry button 403 is a button that a player touches when he/she wishes to make a race entry of a designated racehorse in a designated racing game. The cancel button 404 is a button that the player touches to stop race entry. The message display area 405 displays a message "REQUIRED 20 CREDITS FOR A RACE ENTRY".

In S403, the sub control unit 102 determines whether or not the player has the ability to pay. As per the message displayed in the message display area 405, in this embodiment, 20 credits are required to make a race entry of one racehorse. Therefore, in this determination, the CPU 131 determines that the player has the ability to pay when the player's own credit amount stored in the RAM 132 are not less than 20 credits. If the player has no ability to pay (S403: NO), this entry process terminates. In contrast, if the player has the ability to pay (S403: YES), the process proceeds to S404.

In S404, the sub control unit 102 executes a race operation acceptance process. In this process, the CPU 131 identifies the content of the player's operation in the entry-possible race image of the sub monitor 113, based on a coordinate signal from the touch panel driving circuit 122 and stores it in the RAM 132. The CPU 131 reflects the content of the player's operation in the display of the entry-possible race image of the sub monitor 113.

In S405, the sub control unit 102 determines whether or not the player has touched the cancel button 404. In this determination, the CPU 131 determines whether or not the player has touched the cancel button 404 based on a coordinate signal from the touch panel driving circuit 122. Now, if the player has touched the cancel button 404 (S405: YES), this entry process terminates. In contrast, if the player has not touched the cancel button 404 (S405: NO), the process proceeds to S406.

In S406, the sub control unit 102 determines whether or not the player has touched the entry button 403. In this determination, the CPU 131 determines whether or not the player has touched the entry button 403 based on a coordinate signal from the touch panel driving circuit 122. Now, if the player has not touched the entry button 403 (S406: NO), the process returns to S402 above. In contrast, if the player has touched the entry button 403 (S406: YES), the process proceeds to S407.

In S407, the sub control unit 102 executes an entry-possible race information obtaining process. In this process, the CPU 131 receives entry-possible race information through bidirectional communication with the racing game unit 11. This entry-possible race information includes data as a result of causing the racing game unit 11 to check whether or not a racehorse designated by the player can make a race entry in a designated racing game. If the race entry is possible, the racing game unit 11 puts that race entry into a reserved state.

In the racing game unit 11, the CPU 41 controls race entries of respective racing games by means of character IDs. For example, as per the data table shown in FIG. 16, a racing game and character IDs are associated. Such the data table is stored in the RAM 42 or the external memory device 25, etc.

In S408, the sub control unit 102 determines whether or not a racehorse designated by the player can make a race entry in a designated racing game. In this determination, the CPU 131 makes a determination based on the data on the entry-possible race information received in S407 above. Now, if the racehorse designated by the player can make a race entry in the designated racing game (S408: YES), the process proceeds to S413 below. In contrast, if the racehorse designated by the player cannot make a race entry in the designated racing game (S408: NO), the process proceeds to S409.

In this embodiment, it is possible to forcibly make a race entry in a racing game designated by a player (refer to S414 below) on the condition that the player pays 20 points from the player's own entry points (refer to S412 below), even though there is no longer any racehorse that can make a race entry in the racing game.

In S409, the sub control unit 102 executes a sub monitor display process. In this process, the CPU 131 changes the entry-possible race image being displayed on the sub monitor 131 to an entry-possible race image as shown in FIG. 12. In other words, instead of the entry button 403, the cancel button 404, and the message display area 405 are provided a YES button 413, a NO button 414 and a message display area 415.

The YES button 413 is a button that the player touches to ensure race entry of a designated racehorse in a designated racing game. The NO button 414 is a button that the player touches to stop race entry of a designated racehorse in a designated racing game. The message display area 415 displays the message "REQUIRED 20 POINTS FOR A RACE ENTRY".

In S410, the sub control unit 102 determines whether or not the player has touched the NO button 414. In this determination, the CPU 131 determines whether or not the player has touched the NO button 414 based on a coordinate signal from the touch panel driving circuit 122. Now, if the player has touched the NO button 414 (S410: YES), the process returns to S402 above. Then, the CPU 131 causes the racing game unit 11 to cancel the reservation of the race entry described above, by transmitting a control signal to the racing game unit 11. In contrast, if the player has not touched the NO button 414 (S410: NO), the process proceeds to S411.

In S411, the sub control unit 102 determines whether or not the player has touched the YES button 413. In this determination, the CPU 131 determines whether or not the player has touched the YES button 413, based on a coordinate signal from the touch panel driving circuit 122. Now, if the player has not touched the YES button 413 (S411: NO), the process returns to S410 above. In contrast, if the player has touched the YES button 413 (S411: YES), the process proceeds to S412.

In S412, the sub control unit 102 executes an entry point deduction process. In this process, by deducting from the player's own entry points the points necessary to make a race entry in a racing game, the CPU 131 updates not only the player's own entry points stored in the RAM 132 but also the display in the entry point display area 231 on the high BET image of the sub monitor 113.

In this respect, all of the player's own entry points may be deducted.

It is to be noted that the sub control unit 102 skips an expense collecting process of S413 below, if this entry point deduction process is executed.

In S413, the sub control unit 102 executes the expense collecting process. In this process, by deducting credit amounts necessary for making a race entry in a racing game from the player's own credit amount, the CPU 131 updates not only the player's own credit amount stored in the RAM 132 but also the display in the credit amount display area 221 on the high BET image of the sub monitor 113.

In S414, the sub control unit 102 executes a race entry process. In this process, when storing in the RAM 132 race entry information including data on race entry determination, etc. (data showing player IDs or character IDs, or determinations), the CPU 131 simultaneously transmits it to the racing game unit 11. Further, the CPU 131 adds data showing a credit amount which is required to make a race entry in a racing game when transmitting the race entry information.

Meanwhile, in the racing game unit 11, the CPU 41 associates a racing game with a character ID based on data on this information. In particular, if the player has paid 20 points from the player's own entry points, a race entry in the racing game is forcibly done. The racing game unit 11 may enable this forcible race entry by increasing the number of racehorses to run the racing game, or by replacing any of the racehorses that have already been registered, with it. Further, in the racing game unit 11, the CPU 41 includes a credit amount which is required to make a race entry in a racing game in the collected expense amount of the player ID identified by the race entry information, based on the data added to the race entry information. The collected expense amount is stored in the RAM 42 or the external memory device 25, etc. Thereafter, in the racing game unit 11, the CPU 41 transmits in reply collected expense amount information. In this time, the CPU 41 adds data showing the collected expense amount after the inclusion to the collected expense amount information.

On the other hand, in the sub control unit 102, when a regular BET image or high BET image is displayed on the sub monitor 113, the CPU 131 controls so as to update the display in the expense display area 237, based on the data showing the collected expense amount included in the collected expense amount information.

In S415, the sub control unit 102 determines whether or not operation continues in the entry-possible race image of the sub monitor 113. Now, if the player touches any part of the entry-possible race image of the sub monitor 113 within a predetermined period of time from when the player touched the YES button 413, the CPU 131 determines that the operation continues in the entry-possible race image of the sub monitor 113. Thus, if the operation continues in the entry-possible race image of the sub monitor 113 (S415: YES), the process returns to S402 above. In contrast, if the operation does not continue in the entry-possible race image of the sub monitor 113 (S415: NO), this entry process terminates.

When this entry process terminates, the sub monitor 113 returns to the condition before the entry process starts. Therefore, the sub monitor 113 displays the high BET image above.

[8. Others]

In addition, the present invention is not limited to the above embodiments, but various changes may be made without departing from its scope.

For example, the characteristics of the present invention can be implemented even when configuration is such that the BET operations on a racing game result are limited to those before the racing game.

Also, the race horse gaming machine 1 of the embodiment may be configured in such a manner that the points which is paid for making a race entry in a racing game is included in the collected expense amount. In that case, the following process is executed concerning the collected expense amount above in S414 in FIG. 19.

More precisely, when transmitting the race entry information to the racing game unit 11, the CPU 131 adds data showing the points which is paid for making a race entry in a racing game by the player in S412 in FIG. 19 to the race entry information.

Meanwhile, in the racing game unit 11, the CPU 41 includes the points paid by the player for making a race entry in the racing game in the collected expense amount of the player ID identified by the race entry information, based on the data added to the race entry information.

What is claimed is:

1. A horse race gaming machine comprising:

a plurality of racing games constituting a horse racing game;

a plurality of stations each provided with an input device with which a player inputs information used for progressing the horse racing game;

a performance point which is given to racehorses individually based on a racing game result of the racing game each time the racing game ends;

a horse owning expense, in which a credit amount being collected as the horse-owning-expense from a player who owns any of the racehorses is accumulated; and a processor which is programmed, for progressing the horse racing game by controlling the plurality of stations, to execute processes of:

(1) determining whether or not a player has become an owner of any one of the racehorses based on an input made by the player using the input device; and (2) in the station at which the player who is determined to have become an owner of any one of the racehorses is playing:

(2-1) collecting a predetermined credit amount from all of credit amount which the player has at each predetermined timing;

(2-2) accumulating the credit amount collected in the horse owning expense;

(2-3) determining whether or not a performance point of the racehorse whose owner is the player satisfies a predetermined condition after every ending of the racing game; and (2-4) refunding a credit amount corresponding to a content of the performance point to the player at each time it is determined that the performance point of the racehorse whose owner is the player satisfies the predetermined condition.

2. The horse race gaming machine of claim 1, wherein the processor, when executing the process of (2-1), sets time as the predetermined timing when the player has become an owner of any one of the racehorses.

3. The horse race gaming machine of claim 1, wherein the processor, when executing the process of (2-1), sets time as the predetermined timing when having the racehorse, whose owner is the player, run in the racing game with an input made by the player using the input device.

4. The horse race gaming machine of claim 1, further comprising:

a plurality of character IDs which are respectively applied to the respective racehorses;

a plurality of player IDs which are respectively applied to players who play at the plurality of stations; and a memory storing data related the plurality of character IDs, wherein the processor is programmed to execute processes of:

(a) applying the player ID to a player based on an input made by the player using the input device;

(b) generating ownerships connections data linking the character ID of the racehorse whose owner is the player to the player ID applied;

(c) storing the ownerships connections data in the memory device; and (d) identifying the racehorse whose owner is the player based on the respective ownerships connections data stored in the memory.

5. The horse race gaming machine of claim 3, further comprising:

entry points which is given to each player playing at one of the plurality of stations and is accumulated according to a bet amount specified by the player through an input with the bet amount specifying device, wherein the processor is programmed to execute processes of:

(a) permitting having the racehorse, whose owner is the player, run in the racing game, on condition that, before the racing game is started, the player pays all or part of the entry points, which is given to the player, through the input with the input device.

* * * * *